United States Patent [19]

Takahashi

[11] Patent Number: 5,026,036

[45] Date of Patent: Jun. 25, 1991

[54] DEVICE FOR CONTROLLING STACKING OF PAPER SHEETS ON AN INTERMEDIATE TRAY OF AN IMAGE FORMING APPARATUS

[75] Inventor: Yasuhiro Takahashi, Tokyo, Japan

[73] Assignee: Ricoh Company, Ltd., Tokyo, Japan

[21] Appl. No.: 330,290

[22] Filed: Mar. 29, 1989

[30] Foreign Application Priority Data

Mar. 31, 1988 [JP] Japan ..... 63-79953
Aug. 23, 1988 [JP] Japan ..... 63-110276[U]

[51] Int. Cl.[5] ..... B65H 29/40

[52] U.S. Cl. ..... 271/3.1; 271/187; 271/291; 271/315

[58] Field of Search ..... 271/291, 186, 3.1, 176, 271/187, 315; 355/321, 322

[56] References Cited

U.S. PATENT DOCUMENTS 3,904,192 9/1975 Pfeifer ..... 271/187 X
3,968,960 7/1976 Fedor ..... 271/187
4,088,314 5/1978 Phillips ..... 271/187 X
4,223,885 9/1980 Templeton ..... 271/220
4,228,997 10/1980 Schoonmaker ..... 271/187 X
4,431,178 2/1984 Kokubo ..... 271/187
4,474,366 10/1984 Reider ..... 271/220 X
4,638,993 1/1987 Granzow ..... 271/187 X

*Primary Examiner*—Richard A. Schacher
*Attorney, Agent, or Firm*—Oblon, Spivak, McClelland, Maier & Neustadt

[57] ABSTRACT

A paper stacking control device for use in an electrophotographic copier, printer, facsimile apparatus or similar image forming apparatus having a paper transport path for temporarily stacking paper sheets each carrying an image on one surface thereof on an intermediate tray. A paper sheet being transported by belts which face the intermediate tray is retained by the pawls of coactive rotatable disks and then stacked on the intermediate tray while being turned over due to the rotation of the disks. The paper sheet stacked on the intermediate tray is restrained by paper pressers at a portion thereof adjacent to the leading edge or the trailing edge and is thereby prevented from being displaced in the stacked position.

13 Claims, 15 Drawing Sheets

DEVICE FOR CONTROLLING STACKING OF PAPER SHEETS ON AN INTERMEDIATE TRAY OF AN IMAGE FORMING APPARATUS

BACKGROUND OF THE INVENTION

The present invention relates to an electophotographic copier, printer, facsimile apparatus or similar image forming apparatus of the type having a paper transport path which includes an intermediate tray for temporarily stacking paper sheets each carrying an image on one surface thereof. More particularly, the present invention is concerned with a device for controlling the stacking of such paper sheets on the intermediate tray.

An electrophotographic copier operable in a combination copy mode and a two-sided copy mode is extensively used today. In the combination copy mode, images are reproduced one above another on the same surface of a paper sheet while, in the two-sided copy mode, images are reproduced on both surfaces of a paper sheet. With this type of copier, it is necessary to turn over a paper sheet once on a paper transport path which is defined in the copier. The turn-over is often implemented by a switchback path which branches off a usual paper transport path. Specifically, a paper sheet once driven into the switchback path is switched back so that the paper sheet may then be driven out of the switchback path with its trailing edge standing first. For example, assume a copier whose paper transport path is configured such that a paper sheet driven along a usual transport path is fed to an intermediate tray without being turned over. In such a copier, the switchback path is defined upstream or downstream of the intermediate tray and, in a two-sided copy mode, a paper sheet is once fed into the switchback path and then switched back to leave the switchback path with its trailing end in the lead. Concerning a copier of the type having a paper transport path which causes a paper sheet to be fed to an intermediate tray and then refed from the tray with its trailing edge standing first, the switchback path is defined downstream or upstream of the intermediate tray so that in a combination copy mode a paper sheet may be fed into the switchback once and then switched back.

A problem often encountered with a copier of the type transporting a paper sheet to an intermediate tray and then refeeding it out of the tray is that a paper sheet undergone an image fixing step is curled. A curl would prevent paper sheets from being neatly stacked on the intermediate tray. To eliminate this problem, a paper guide member may be used which presses the upper surface of the uppermost paper sheet relatively lightly, as disclosed in Japanese Patent Laid-Open Publication (Kokai) No. 57-72525 by way of example.

However, in a copier having a long paper transport path such as a switchback path and implementing the combination copy mode or the two-sided copy mode by turning over a paper sheet at a position upstream or downstream of an intermediate tray as stated above, it is necessary for the switchback path to have a length which is great enough to accommodate the entire length of the largest size of paper sheets usable with the copier. This not only increases the overall dimensions of the copier but also increases the length of the transport path and thereby the copying time. Such a long switchback path needs a substantial number of structural parts and therefore a substantial cost and is complicated to degrade the reliability of operation. Further, since the prior art paper guide member for eliminating the curl problem previously discussed exerts only a small force which lightly presses the upper surface of the uppermost paper on the intermediate tray, a paper sheet reaching the intermediate tray is apt to dislocate a paper sheet previously stacked on the tray due to friction between the paper sheets, elasticity of the paper sheets, etc.

SUMMARY OF THE INVENTION

It is therefore an object of the present invention to provide a reliable paper stacking control device for an image forming apparatus which allows paper sheets to be accurately stacked in a predetermined position on an intermediate tray.

It is another object of the present invention to provide a reliable paper stacking control device for an image forming apparatus which, when a paper sheet reached an intermediate tray is curled, presses the curl while preventing a stack of paper sheets on the tray from being dislocated.

In an image forming apparatus in which a paper sheet carrying an image on one surface thereof is temporarily stacked on an intermediate tray which is disposed on a paper transport path, a device for controlling stacking of the paper sheet on the intermediate tray of the present invention comprises a transporting device located to face the intermediate tray for transporting the paper sheet to the intermediate tray, a reversing device for stacking the paper sheet on the intermediate tray while turning over the paper sheet, and a positioning device for locating and holding a leading edge of the paper sheet stacked on the intermediate tray by the reversing device in a paper hold position which is defined on the intermediate tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the paper stacking control device in accordance with the present invention will be described in detail with reference to the accompanying drawings.

FIRST EMBODIMENT

Figure 1:
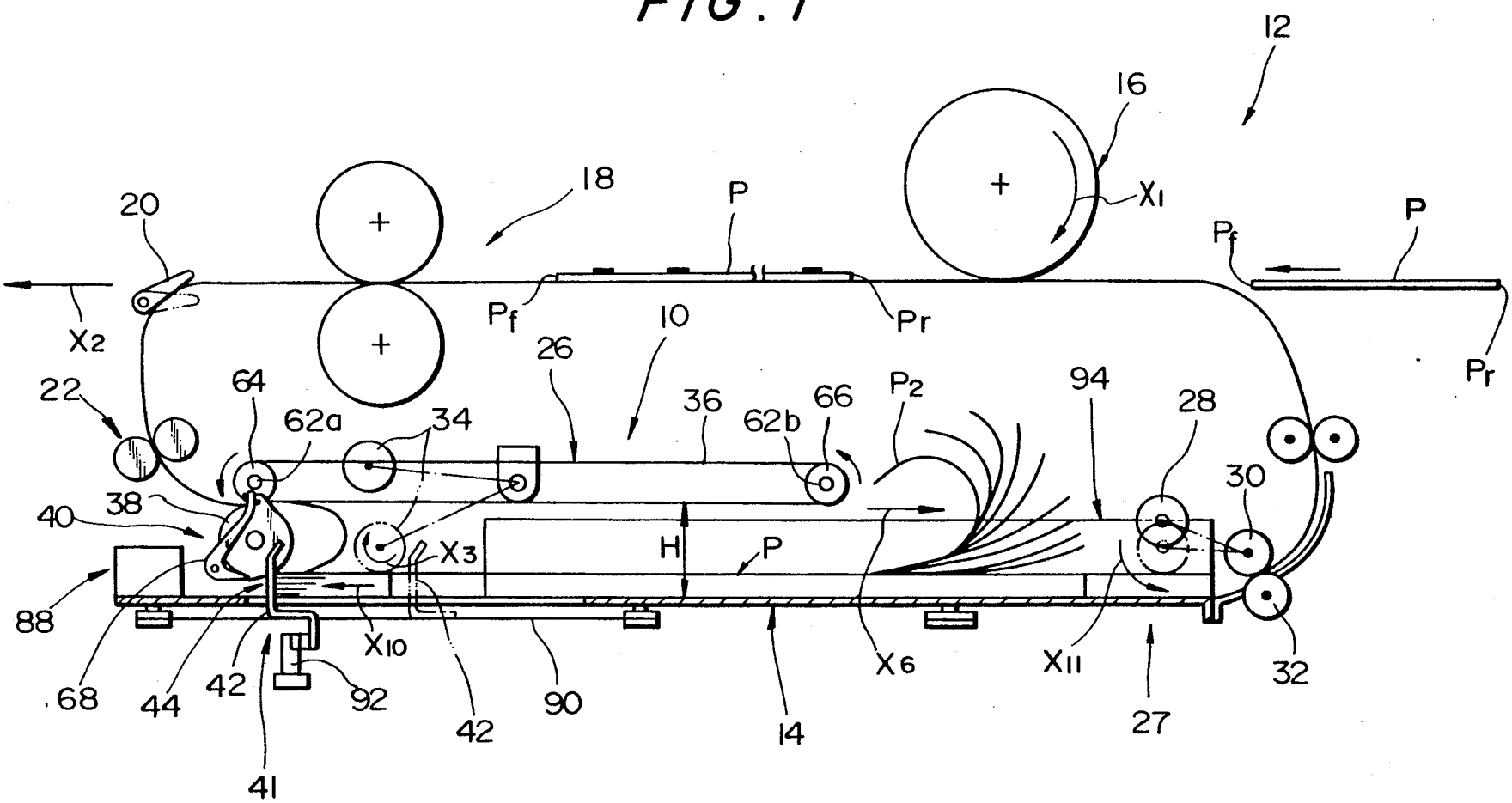
FIG. 1 is a sectional side elevation of a copier belonging to a family of image forming apparatuses of the type having a combination copying and a two-sided copying capability and to which a first embodiment of the paper stacking control device in accordance with the present invention and its modification are applied.

Referring to FIG. 1 of the drawings, a paper stacking control device embodying the present invention, generally 10, is installed in a copier 12 which is an example of image forming apparatuses having a combination copying and a two-sided copying capability. The device 10 temporarily stacks paper sheets P each carrying an image on one surface thereof on an intermediate tray 14. The copier 12 electrostatically forms a latent image on a photoconductive drum 16 and develops the latent image by a developing device (not shown). While the drum 16 is rotated as indicated by an arrow $X_1$ in the figure, the developed image is transferred from the drum 16 to a paper sheet P which is fed from a paper feeding device (not shown). The paper sheet with the image is separated from the drum 16 and then transported to a fixing device 18 face up. In an ordinary copy mode as distinguished from the combination or two-sided copy mode, a selector pawl 20 is switched over to a position indicated by a phantom line in the figure to allow the paper sheet P to be directly discharged in a direction indicated by an arrow $X_2$. In the combination or the two-sided copy mode, the selector pawl 20 is positioned as indicated by a solid line so that the paper sheet P carrying the image on one surface thereof is transported to the control device 10 by a transport roller pair 22, two inlet rollers 24 (see FIG. 3), and a paper transport device 26 so as to be temporarily loaded on the intermediate tray 14. Subsequently, the paper sheet P is shifted to a refeed position 27 where a pickup roller 28 is positioned. As the paper sheet P begins to be refed by the pickup roller 28, it is separated from the others on the intermediate tray 14 by a feed roller 30 and a reverse roller 32 and transported toward the drum 16 again. Before reading the intermediate tray 14, the paper sheet P is not turned over when the combination mode is selected and is turned over when the two-sided copy mode is selected, as described in detail later. In the figure, the reference numeral 34 designates a return roller which is rotatable in a direction indicated by an arrow $X_3$ for aligning the leading edges (left edges as viewed in the figure) of the paper sheets P loaded on the tray 14.

Figure 2:
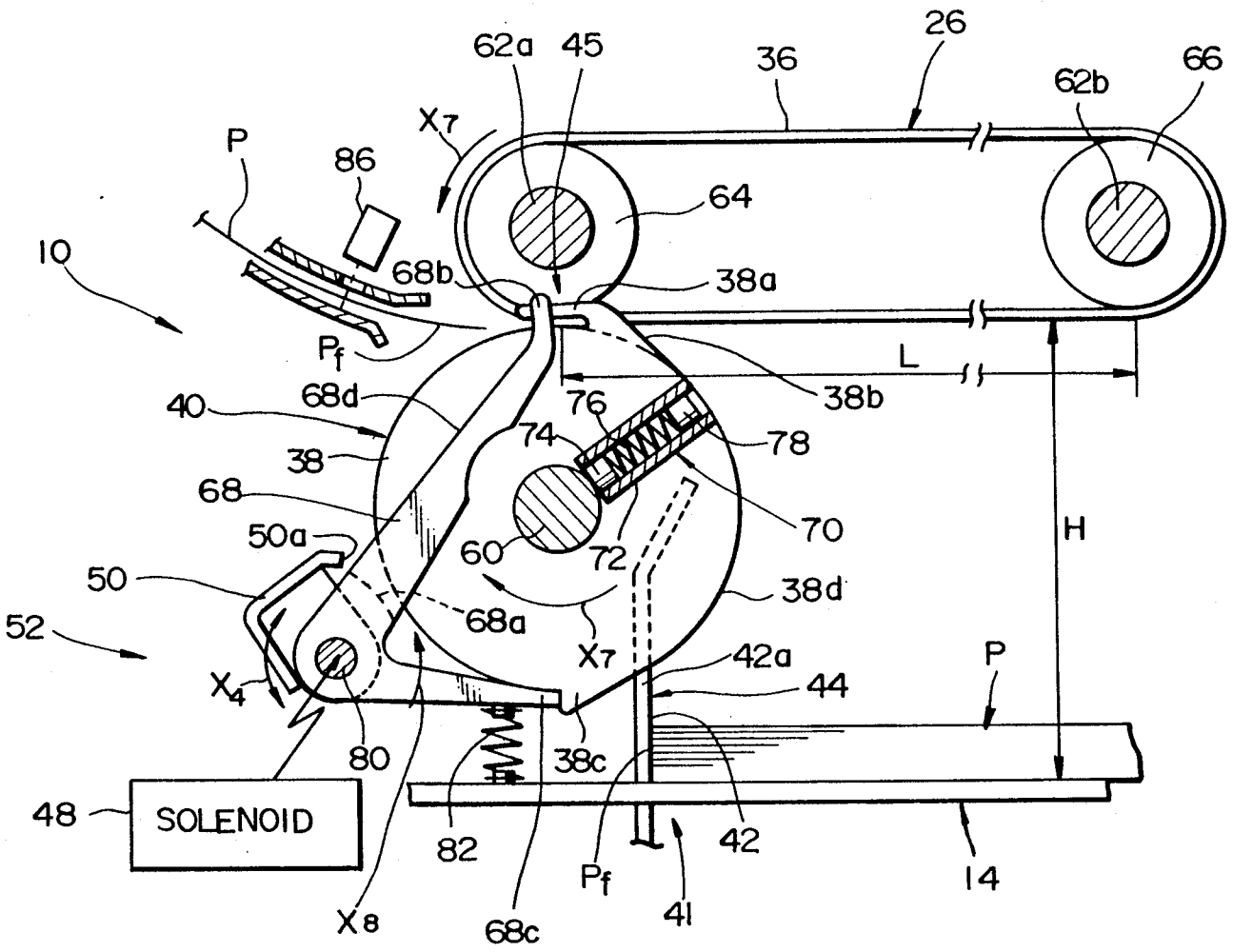
FIG. 2 is a sectional front view of a part of the control device shown in FIG. 1.
Figure 3:
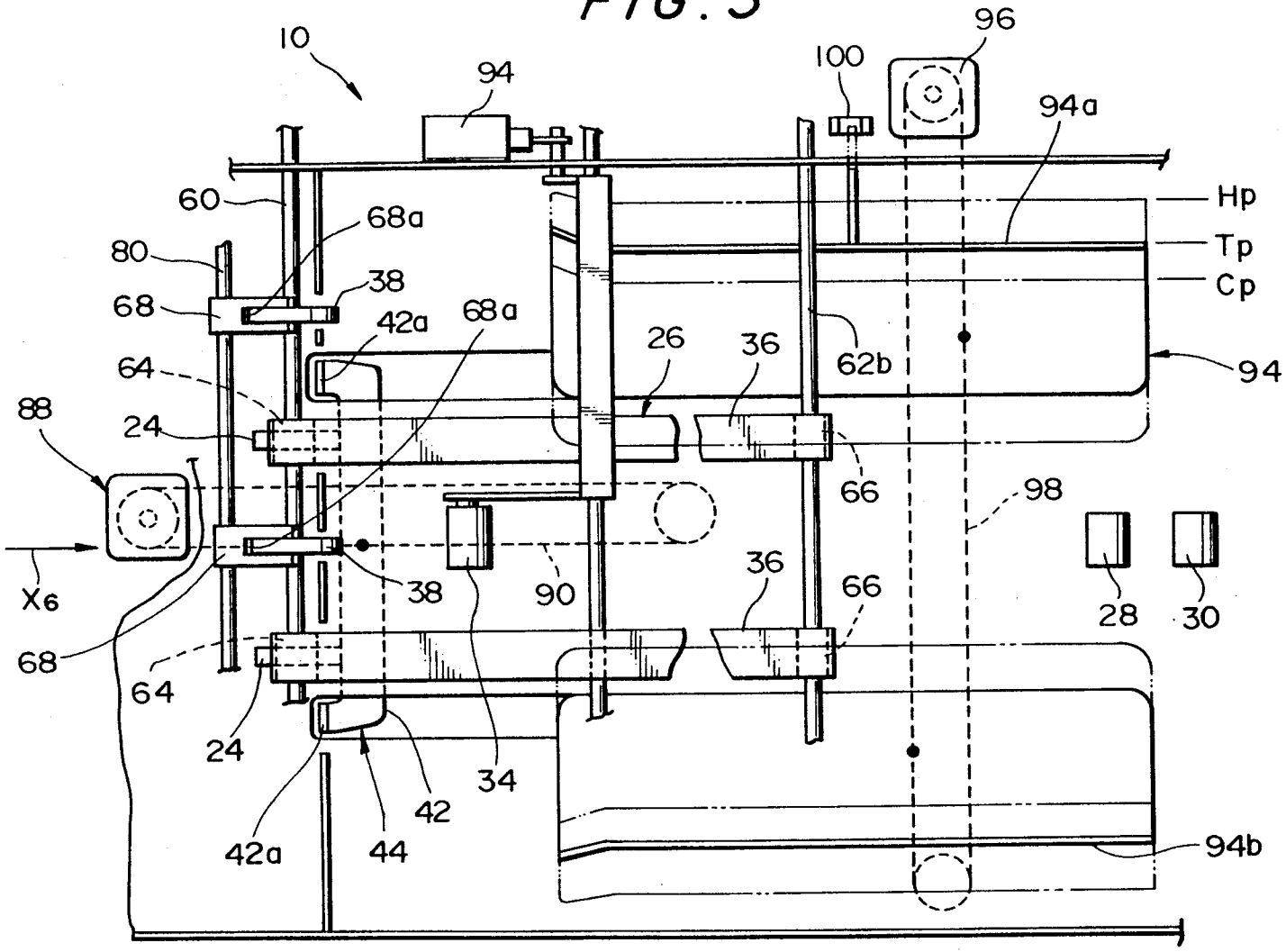
FIG. 3 is a plan view of the device shown in FIG. 2.
Figure 4:
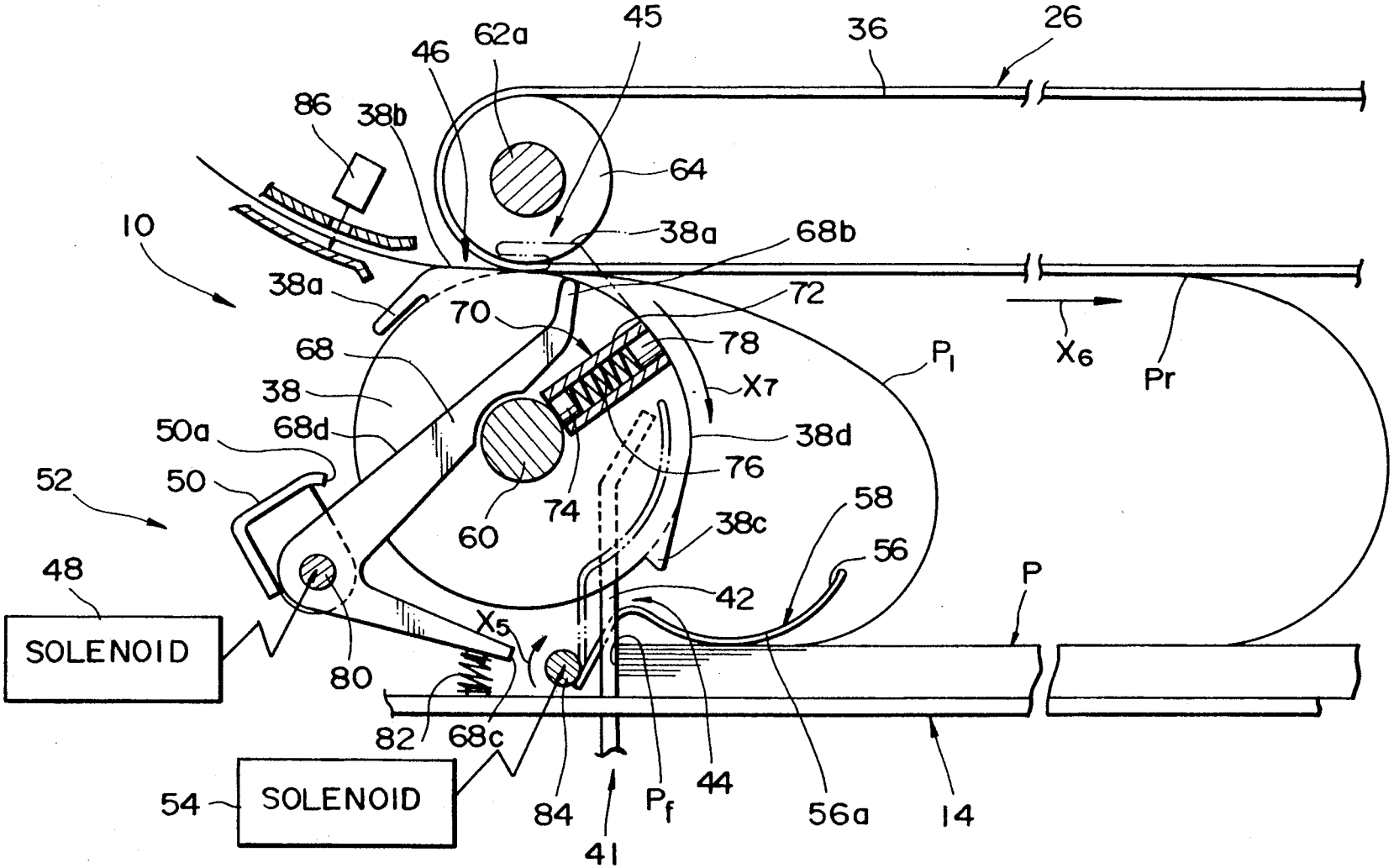
FIG. 4 is a partly sectional front view showing the control device of FIGS. 2 and 3 in a particular condition wherein a paper sheet is beginning to be stacked on an intermediate tray.

As shown in FIGS. 2 and 3, the control device 10 is made up of the paper transport device 26 for feeding a paper sheet P to the intermediate tray 14, a reversing device 40 rotatable while retaining the leading edge Pf of an incoming paper sheet Pf so as to turn over the paper sheet P, and a paper positioning device 44 for aligning the leading edges Pf of the paper sheets P sequentially stacked on the intermediate tray 14 by the reversing device 40 in a predetermined paper hold position 41. The paper transport device may be implemented by two rubber belts 36, for example. The reversing device 40 may be constituted by two pawls 38 each having a retaining portion 38*a*. Further, the paper positioning device 44 is constituted by a stop 42. Each pawl 38 includes a contact surface 38*b* which is contiguous with the retaining portion 38*a*. More specifically, as shown in FIG. 4, when a paper sheet $P_1$ being driven by the belts 36 of the paper transport device 26 has a size greater than a predetermined size, the contact surface 38*b* of each pawl 38 makes sliding contact with the lower surface of the paper sheet $P_1$ at a position 46 indicated by a solid line that precedes a paper receive position 45 where the pawl 38 indicated by a phantom line in FIG. 4 retains the leading edge Pf of the paper sheet $P_1$, after the pawl 38 has turned over the paper sheet $P_1$. In this position, the contact surfaces 38*b* temporarily stop the rotation of the pawls 38.

As shown in FIG. 2, the control device 10 further includes an implementation for controllably driving the pawls 38 in a rotary motion. Specifically, a drive control device 52 is made up of a solenoid 48 and a release plate 50 which is driven by the solenoid 48 to rotate as indicated by a double-headed arrow $X_4$. A paper restraining device 58, as shown in FIG. 4, is implemented by a paper presser 56 and constructed such that, when a solenoid 54 is energized, the paper presser 56 is rotated as indicated by an arrow $X_5$ to restrain the leading edge portions Pf of the paper sheets P which have been aligned at the paper hold position 41 on the intermediate tray 14 by the stop 42.

As shown in FIG. 3, the rubber belts 36 of the paper transport device 26 are spaced apart from each other and extend in parallel with an intended direction of paper transport $X_6$. Specifically, the rubber belts 36 are individually passed over two rollers 64 and two rollers 66 which are journalled to stationary portions of the copier 12 by roller shafts 62*a* and 62*b*. A motor (not shown) drives the belts 36 only in a direction indicated by an arrow $X_7$ in FIG. 2. As shown in FIGS. 1 and 2, the rubber belts 36 extend in the paper transport direction $X_6$ substantially in parallel with the intermediate tray 14. The effective feed length of the belts 36, i.e., a length of a portion of each belt 36 which contacts with and exerts a transporting force on the paper sheet P is determined in consideration of the maximum paper size usable with the copier 12 as well as the space available around the belts 36. The distance H between the belts 36 and the intermediate tray 14 is an important consideration. Should the distance H be too small, the paper sheet P would be bent by a small radius of curvature when transported during two-sided copy mode operation and, therefore, would suffer from a curl. Conversely, should the distance H be too large, the force required to transport the paper sheet P to the intermediate tray 14 would not be achievable. For paper sheets of ordinary use, the distance H is preferably selected to be 20 millimeters to 100 millimeters. The surface of each belt 36 may be provided with undulation or a certain pattern to increase the paper transporting force, if desired.

As shown in FIG. 2, each pawl 38 has a substantially disk-like configuration and has substantially the same outside diameter as each inlet roller 24. The retaining portion 38*a* is provided on the circumferential edge of the pawl 38 to extend in the tangential direction and is provided with an opening for receiving the leading edge Pf of the paper sheet P. A stepped portion 38*c* is also provided on the pawl 38 at an angular distance of substantially 180 degrees from the retaining portion 38*a* and is engageable with a lever 68 which will be described. The contact surface 38*b* of each pawl 38 protrudes substantially in the tangential direction from the circumferential edge of the pawl 38. As shown in FIG. 4, while the contact portion 38*b* makes contact with the underside of the paper sheet $P_1$ being transported along the path between the paper transport device 26 and the inlet rollers 24, a clutch 70 only idles to temporarily stop the rotation of the pawl 38 in the illustrated position. Usually (i.e. when the pawl 38 is free from external restraint), the clutch 70 is coupled to operatively connect the pawl 38 to the inlet roller 60 to thereby rotate the pawl 38. As shown in FIG. 3, the pawls 38 are rotatably mounted on an inlet roller shaft 60. The clutch 70 is mounted on one side of each pawl 38, as shown in FIG. 2. The rotation of the inlet roller shaft 60 is transmitted to the pawl 38 by the clutch 70, whereby the pawl 38 tends to rotate in the direction $X_7$. The clutch 70 includes a cylindrical tube 72 in which a sliding member 74 and a spring 76 are received. One end of the tube 72 is stopped by a screw 78. Exerting a relatively small resilient force, the spring 76 lightly presses one end of the sliding member 74 against the outer periphery of the inlet roller shaft 60. When a load greater than a predetermined load is exerted on the pawl 38 from the outside, the inlet roller shaft 60 and the sliding member 74 slide on each other so that the clutch 70 idles. So long as such an external force is absent, the shaft 60 and sliding member 74 are interconnected to cause the pawl 38 into rotation as indicated by the arrow $X_7$ in FIG. 2.

As shown in FIG. 3, a lever shaft 80 extends in parallel with the inlet roller shaft 60. Two levers 60 each being associated with respective one of the pawls 38 are rotatably mounted on the lever shaft 80, and each is formed with a notch 68*a*. The pawls 38 are individually received in the notches 68*a*, as shown in FIG. 2. Each lever 60 has an operating end 68*b* which protrudes into the transport path which is defined by the paper transport device 26 and the inlet rollers 24 (see FIG. 2), and a locking end 68*c*. Compression springs 82 are each anchored at one end to a stationary portion of the copier 12 and at the other end to the underside of respective one of the locking portions 68*c* of the levers 68, whereby the levers 68 are constantly biased in a direction indicated by an arrow $X_8$ in FIG. 2. Hence, the upper surfaces of the locking ends 68*c* are individually held in light sliding contact with the circumferential edges 38*d* of the pawls 38. As shown in FIG. 2, when the tip of the locking end 68*c* of each lever 68 abuts against the stepped portion or shoulder 38*c* of the associated pawl 38, the pawl 38 is prevented from rotating in the direction $X_7$ so that the inlet roller shaft 60 and the sliding member 74 of the clutch 70 only slide on each other. As the leading edge Pf of the paper sheet P entering the transport path between the paper transport device 26 and the inlet rollers 24 abuts against the operating ends 68*b* of the levers 68, the levers 68 are rotated about the lever shaft 80 in the direction opposite to the direction $X_8$ of FIG. 2 resulting in the locking ends 68*c* thereof being moved away from their associated shoulders 38*c*.

The stop 42 of the paper positioning device 44 is positioned substantially perpendicularly to the intermediate tray 14 in the vicinity of the pawls 38. As shown in FIGS. 2 and 3, the upper portion of the stop 42 is slightly bent downstream with respect to the paper transport direction at laterally opposite ends thereof to form abutting portions 42*a*. As the leading edge Pf of the paper sheet P being retained by the retaining portions 38*a* of the pawls 38 and transported in the direction $X_7$ of FIG. 2 abuts against the abutting portions 42*a*, the paper sheet P is released from the retaining portions 38.

The release plate 50 of the drive control device 52 is mounted on a lever shaft 80. When the solenoid 48 is energized, the lever 80 is rotated by an arm (not shown) in a direction indicated by an arrow $X_9$ in FIG. 5. As a result, the release plate 50 urges a side surface 68*d* of the lever 68 to the right to retract the operating end 68*b* of the lever 68 from the paper transport path. At the same time, the locking end 68*c* of the lever 68 is released from the shoulder 38*c* of the pawl 38 to allow the pawl 38 to rotate in the direction $X_7$, and then engages a locking portion of the release plate 50 with the shoulder 38*c* to stop the rotation of the pawl 38. Consequently, the retaining portion 38*a* of the pawl 38 is retracted to the illustrated position away from the paper transport path. This releases the leading edge Pf of the paper sheet P, i.e., invalidates the function of the pawl 38.

The paper presser 56 of the paper restraining device 58 is implemented by a leaf spring or a flexible soft material, for example. As shown in FIG. 4, a paper presser shaft 84 is journalled to a stationary part of the copier 12 in parallel with the inlet roller shaft 60, the paper presser 56 being mounted at one end thereof on the paper presser shaft 84. While awaiting the arrival of the paper sheet P, the paper presser 56 remains stationary within the range of the pawl 38, as indicated by a phantom line. When the paper presser 56 is rotated, its arcuate pressing portion 56*a* is brought into contact with the uppermost paper sheet P of the stack loaded in a predetermined position on the intermediate tray 14, as indicated by a solid line. In this position, the paper presser 56 restrains a portion of the paper sheet P adjacent to the leading edge Pf so as to prevent the sheet P from being displaced. More specifically, a sensor 86 such as a reflection type photosensor is located in close proximity to the inlet of the paper transport device 26 to sense the leading edge of the paper sheet P. As the sensor 86 senses the leading edge of the paper sheet P, the solenoid 54 is energized upon the lapse of a predetermined period of time. Then, the solenoid 54 rotates the paper presser shaft 84 by a predetermined angle in the direction $X_5$ of FIG. 4 through an arm (not shown) so that the leading edge Pf of the paper sheet P beginning to be stacked on the intermediate tray 14 is restrained.

Hereinafter will be described an arrangement provided around the intermediate tray 14.

As shown in FIGS. 1 and 3, the bottom of the stop 42 is connected to a drive wire 90 which is driven by a reversible stepping motor 88. When the stepping motor 88 is rotated by the number of steps associated with any of conditions which are programmed beforehand in association with paper sizes and paper orientations (vertically long feed or horizontally long feed), the stop 42 is shifted relative to a home sensor 92 to a particular position suitable for a paper sheet to be transported. As shown in FIG. 1, the return roller 34 is provided downstream of the pawls 38 and returns the paper sheet P being laid on the intermediate tray 14 in a direction indicated by an arrow $X_{10}$ at a predetermined timing. A solenoid 94 (FIG. 3) is operated to move the return roller 34 between two positions which are indicated by a phantom line and a solid line in FIG. 1. Preferably, the return roller 34 is made of a foaming material or similar material having a relatively small coefficient of friction, so that it may slip on the upper surface of a paper sheet when the latter abuts against the stop 42. A jogger 94 having a pair of jogger fences 94*a* and 94*b* is provided at the refeed position 27 of the intermediate tray 14 for aligning the side edges of the stack of papers P, i.e. for preventing the paper sheets P from being refed askew. The jogger fences 94*a* and 94*b* are driven by a drive wire 98 which is in turn driven by a reversible stepping motor 96 shown in FIG. 3, assuming a particular position associated with designated one of programmed paper sizes and designated one of programmed paper orientations.

The operation of the control device 10 in a two-side copy mode is as follows.

The paper sheet P carrying an image on one surface thereof is transported through the fixing device 18 to the transport roller pair 22 and therefrom to between the inlet rollers 24 (FIG. 3) and the rubber belts 36 of the paper transport device 26. At this instant, as shown in FIG. 2, the pawls 38 are held in a halt with their shoulders 38*c* being locked by the locking ends 68*c* of the levers 68. Hence, the leading edge Pf of the paper sheet P is received in the openings of the retaining portions 38*a* of the pawls 38 while urging the operating ends 68*c* of the levers 68. As a result, the locking ends 68*c* are disengaged from the shoulders 38*c* to cause the pawls 38 into operative connection with the inlet roller shaft 60 via the clutches 70, whereby the pawls 38 begin to rotate in the direction $X_7$ while retaining the leading edge Pf of the paper sheet P with their retaining portions 38*a*. The paper P is transported by being held between the belts 36 of the paper transport device 26 and the inlet rollers 24 (FIG. 3). As soon as the leading edge Pf of the paper sheet P abuts against the stop 42, only the pawls 38 continuously rotate in the direction $X_7$ so that the paper sheet P is stacked on the intermediate tray 14 with its leading edge Pf released from the retaining portions 38*a* of the pawls 38.

In the above condition, the paper presser 56 is held in a substantially vertical position as represented by a phantom line in FIG. 4 and, therefore, does not interfere with the transport of the paper sheet P toward the intermediate tray 14. As shown in FIG. 4, when the paper sheet $P_1$ begins to be stacked on the intermediate tray 14 with its leading edge sanding first, the solenoid 54 is energized to rotate the paper presser shaft 84 in the direction $X_5$ of FIG. 4 by a predetermined angle. Then, the shaft 84 brings the paper presser 56 into pressing contact with the portion of the paper P adjacent to the leading edge Pf, as indicated by a solid line. When the pawls 38 are rotated to the position shown in FIG. 4, their contact surfaces 38*b* abut against the underside of the paper sheet $P_1$ being held between and transported by the inlet rollers 24 and belts 36 and, hence, a force tending to restrict the rotation of the pawls 38 acts on the pawls 38. As a result, the inlet roller shaft 60 and the sliding members 74 of the clutches 70 slide on each other, causing the pawls 38 to stop in the illustrated position. This allows the paper sheet $P_1$ to be further transported by sliding on the paper contact surfaces 38*b* of the pawls 38. When the trailing edge Pr of the paper sheet P moves away from the contact surfaces 38*d*, the pawls 38 become free to rotate and are rotated in the direction $X_7$ again. Then, the levers 68 regain their original positions where the locking ends 68*c* individually lock the shoulders 38*c* of the pawls 38, so that the pawls 38 are restored to the illustrated stand-by position.

Even after the paper sheet P has moved away from the contact surfaces 38*d* of the pawls 38, its trailing edge portion is continuously driven by the belts 36 and inlet rollers 24 because the leading edge Pf remains in abutment against the stop 42. Hence, as shown in FIG. 4, the paper sheet P is continuously transported while being bent between the belts 36 and the intermediate tray 14. Even after the trailing edge Pr of the paper sheet P has moved away from the inlet rollers 24, the sheet P is continuously driven by a force exerted by the belts 36 in the direction $X_6$ because the upper surface of the trailing edge side of the sheet P is held in contact with the underside of the belts 36 by the elasticity of the paper itself. As soon as the trailing edge Pr of the paper sheet P is released from the belts 36, the paper sheet P is fully stacked on the intermediate tray 14 with its bend straightened, as shown in FIG. 1. By the procedure described so far, paper sheets P are stacked on the intermediate tray one after another. In the case that the paper sheet P has a substantial degree of elasticity as represented by a paper sheet $P_2$ in FIG. 1, its trailing edge is apt to spring up when released from the belts 36, effecting the stacking position. In the illustrative embodiment, the paper presser 56 restrains the leading edge Pf of the paper sheet P and thereby eliminates such a problem. When the next paper sheet reaches a position immediately ahead of the paper transporting device 26 and inlet rollers 24, the sensor 86 senses the leading edge of the paper so that the paper presser 56 is returned to the original position as indicated by a phantom line in FIG. 4.

As the above procedure is repeated to stack all of the predetermined number of paper sheets on the intermediate tray 14, the stepping motor 88 is rotated by the number of steps associated with a particular programmed paper size and a particular programmed paper orientation. Then, the drive wire 90 is driven to in turn move the stop 42 to the left away from the home sensor 92 to a designated position, whereby the paper stack on the intermediate tray 14 is shifted to the refeed position 27 as indicated by a phantom line in FIG. 1. In the refeed position 27, the jogger fences 94*a* and 94*b* (FIG. 3) are brought close to the paper stack to align the widthwise side edges of the paper stack. As shown in FIG. 3, the jogger fences 94*a* and 94*b* are usually held in a home position Hp which is determined by a home sensor 100. Before the start of stacking, the jogger fences 94*a* and 94*b* are moved to a stand-by position Tp where they are spaced apart by a distance slightly greater than the width of paper sheets. As soon as the paper stack is shifted by the stop 42 to the refeed position 27, the jogger fences 94*a* and 94*b* are moved back and forth a plurality of times between a correcting position Cp which is substantially equal to the width of paper sheets and the stand-by position Tp, thereby aligning the side edges of the paper sheets. After the last movement to the correcting position Cp, the jogger fences 94*a* and 94*b* are brought to a halt. Thereafter, the pickup roller 28 which is constantly rotated is lowered from its retracted position onto the uppermost paper sheet of the paper stack to refeed the paper sheets one by one.

The operation of the control device 10 in the combination copy mode will be described hereinafter.

In the combination copy mode, it is necessary to stack paper sheets on the intermediate tray 14 without turning them over, i.e., by maintaining them face down. After the combination copy mode has been selected on an operation board of the copier 12, the first paper sheet P is fed toward the inlet rollers 24 (FIG. 3) and belts 36. When the paper sheet P is about to reach the inlet rollers 24 and belts 36, the sensor 86 senses its leading edge Pf to energize the solenoid 48. Then, the release plate 50 is rotated in the direction $X_9$ of FIG. 5 to in turn rotate the levers 68 in the direction $X_9$ with their locking portions 50*a*, so that the locking ends 68*c* of the levers 68 are disengaged from the shoulders 38*c* of the pawls 38. This allows the pawls 38 to rotate in the direction $X_7$ until the shoulders 38*c* thereof abut against the locking portions 50*a*, as illustrated. In this position, the retaining portions 38*a* of the pawls 38 are retracted from the paper transport path. Hence, a paper sheet $P_3$ being transported by the inlet rollers 24 and belts 36 is caused to advance straight toward the intermediate tray 14 without being turned over. Every time a paper sheet P is stacked on the intermediate tray 14, the return roller (FIG. 1) 34 is lowered at a predetermined timing and is rotated in the direction $X_3$ to cause the paper sheet P into abutment against the stop 42 for alignment. Subsequently, the return roller 34 is raised again by the solenoid 94 (FIG. 3) to prepare for the arrival of the next paper sheet. After the specified number of paper sheets P have been stacked, they are refed one after another by the same procedure as with the two-sided copy mode.

Figure 5:
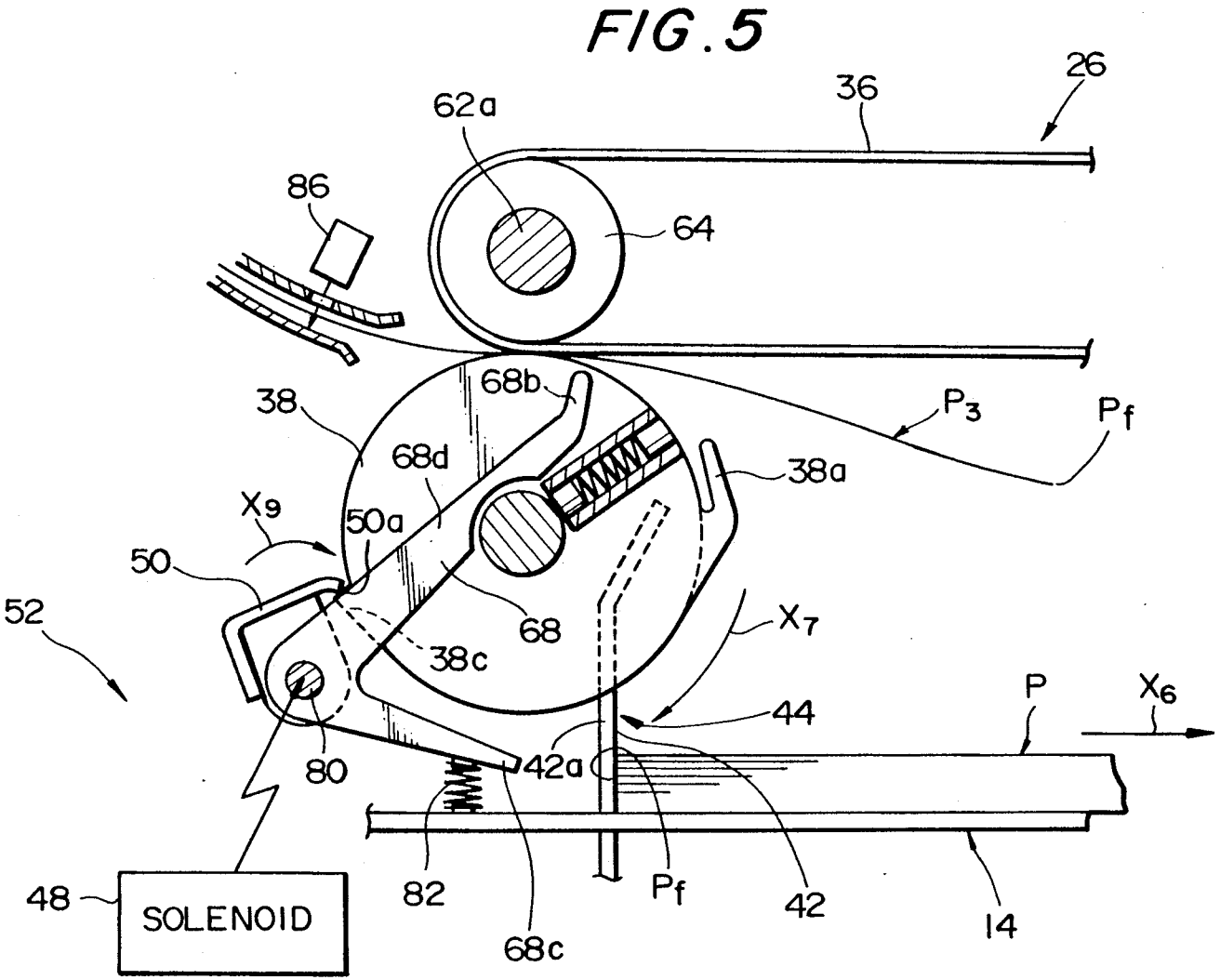
FIG. 5 is a view similar to FIG. 4, showing the control device being operated in a combination copy mode.

In the combination copy mode, the paper sheet $P_3$ which is about to be laid on the intermediate tray 14 as shown in FIG. 5 slides on the paper sheet P already stacked on the tray 14 and is therefore apt to move the latter in the direction $X_6$. In the illustrative embodiment, the paper presser 56 (FIG. 4) is provided for restraining the leading edge Pf of the paper sheet P and effectively prevents the underlying paper sheet P from being entrained by the incoming paper sheet $P_3$.

While the paper presser 56 has been shown and described as being operated every time a paper sheet arrives as the intermediate tray 14, such an operation may be effected only with a paper sheet stacked on the tray 14 last, for the following reasons. Since the distance H between the belts 36 and the intermediate tray 14 is relatively short as previously stated, paper sheets P except for those whose length in the paper transport direction is extremely short are transported with their trailing edge held in contact with the belts 36 down to a position adjacent to the end of the effective feed length L of the belts 36. Hence, as shown in FIG. 4, the leading edge Pf of a preceding paper sheet is pressed by the leading edge of another sheet which enters the intermediate tray 14 subsequently and thereby freed from dislocation. Only the last paper sheet entering the intermediate tray 14 does not share such an effect.

Figure 6:
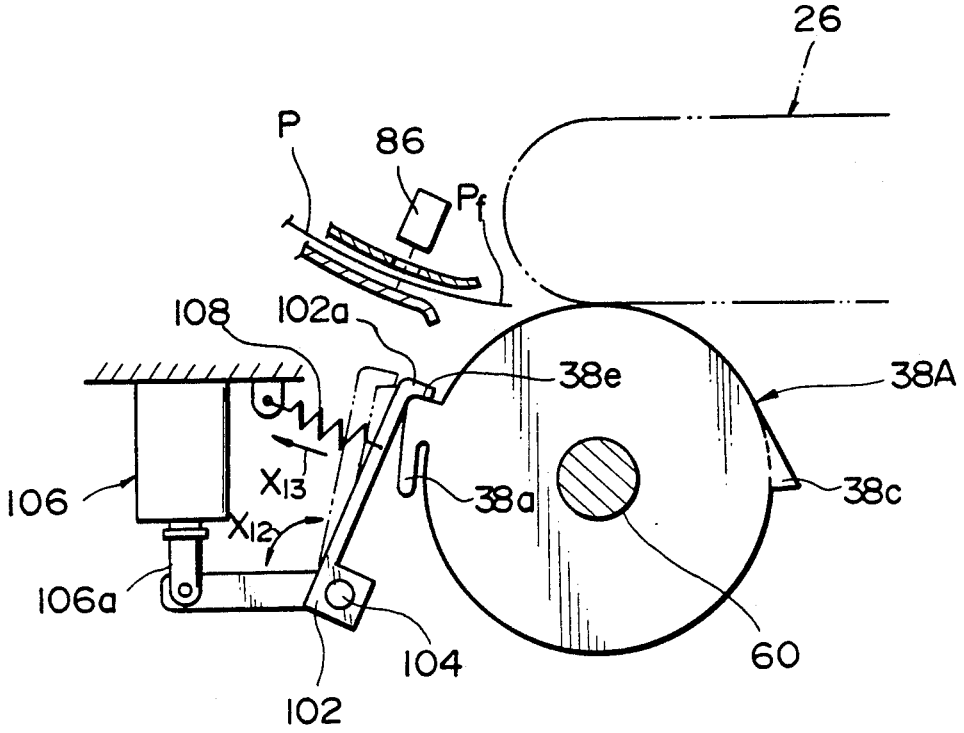
FIGS. 6 to 9 are partly sectional front views each showing a different modification of the first embodiment.

Referring to FIG. 6, a modified form of the first embodiment is shown. In the figure, similar components or structural elements are designated by the same reference numerals, and redundant description will be omitted for simplicity.

In the modification, a pawl 38A has an engaging surface 38*e* in the vicinity of the retaining portion 38*a*. A generally L-shaped stop 102 is located in close proximity to the pawl 38A and mounted on a shaft 104 to be rotatable in a direction indicated by an arrow $X_{12}$. The stop 102 is rotatably connected to a plunger 106*a* of a solenoid 106 at one end and provided with a locking portion 102*a* at the other end, the solenoid 106 being securely mounted on a stationary part of the copier 12. A spring 108 is anchored at one end to a stationary part of the copier 12 and at the other end to the locking portion 102*a*, so that the stop 102 is constantly biased in the direction $X_{12}$. When the solenoid 106 is deenergized, the locking portion 102*a* is released from the engaging surface 38*e* of the pawl as indicated by a phantom line. When the solenoid 106 is energized, the locking portion 102*a* is rotated to a position indicated by a solid line where it temporarily retains the engaging surface 38*e*. This temporarily stops the movement of the pawl 38A at a position ahead of a position where the pawl 38A retains the leading edge Pf of the paper sheet P. Such a modified arrangement also achieves the operation and effect discussed in relation to the first embodiment.

Figure 7:
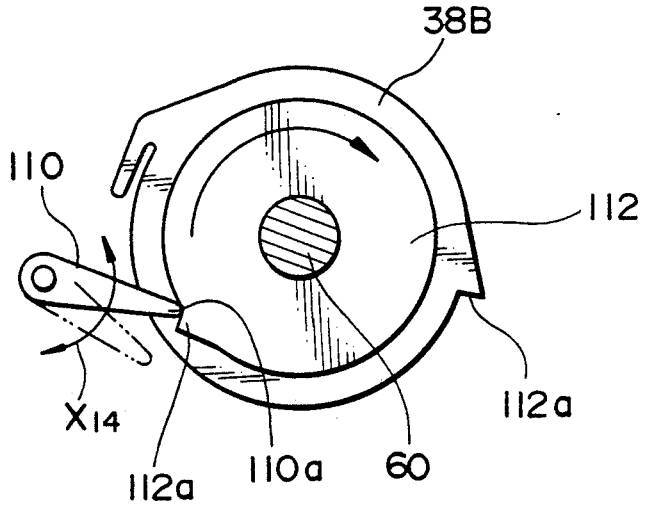

Further, as shown in FIG. 7, there may be used a stop 110 having a locking portion 110*a* and driven by a solenoid (not shown) to rotate in a direction indicated by an arrow $X_{14}$, and a disk 112 provided on the side of a pawl 38B and having an engaging portion 112*a*. In this configuration, when the locking portion 110*a* of the stop 110 is brought into engagement with the engaging portion 112*a* of the disk 112, the rotation of the pawl 38B will be stopped for a moment.

Figure 8:
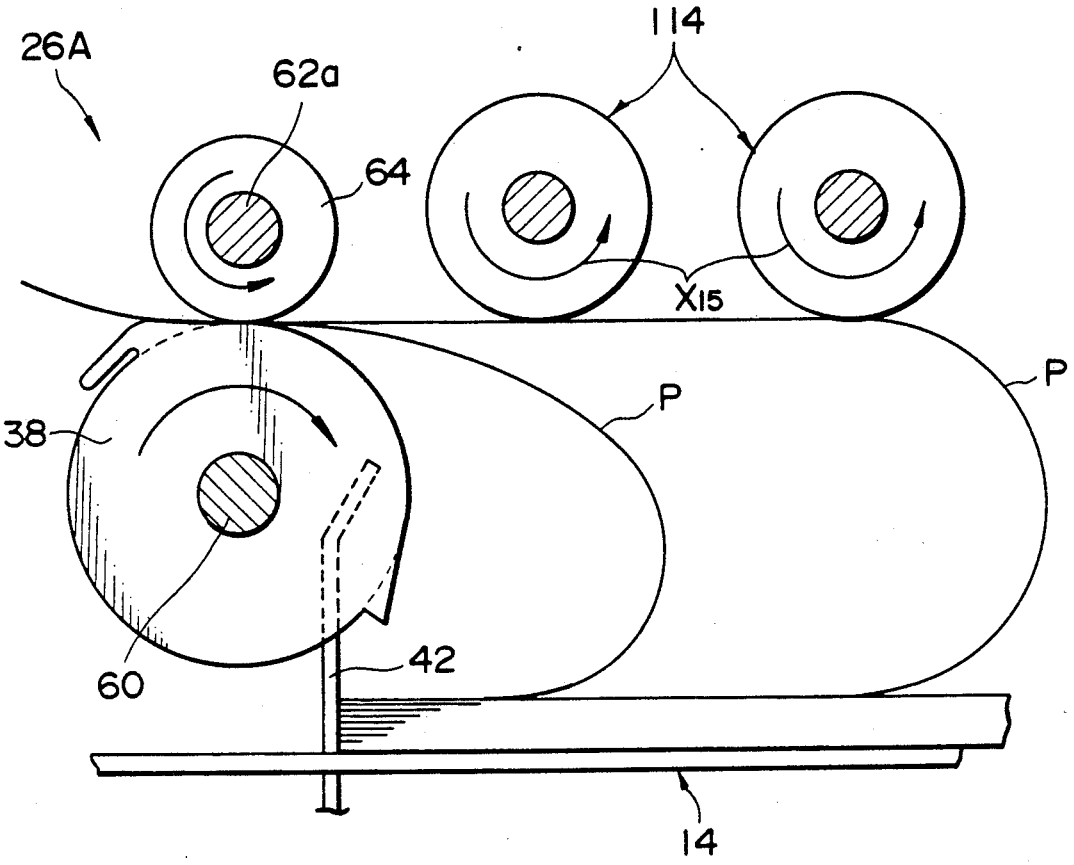

In the embodiment and its modification described above, the paper transport device 26 is implemented by the belts 36 which face the intermediate tray 14. Alternatively, as shown in FIG. 8, use made be made of a plurality of rollers 114 each being rotatable in a direction $X_{15}$ or any other suitable rotary transporting members.

Figure 9:
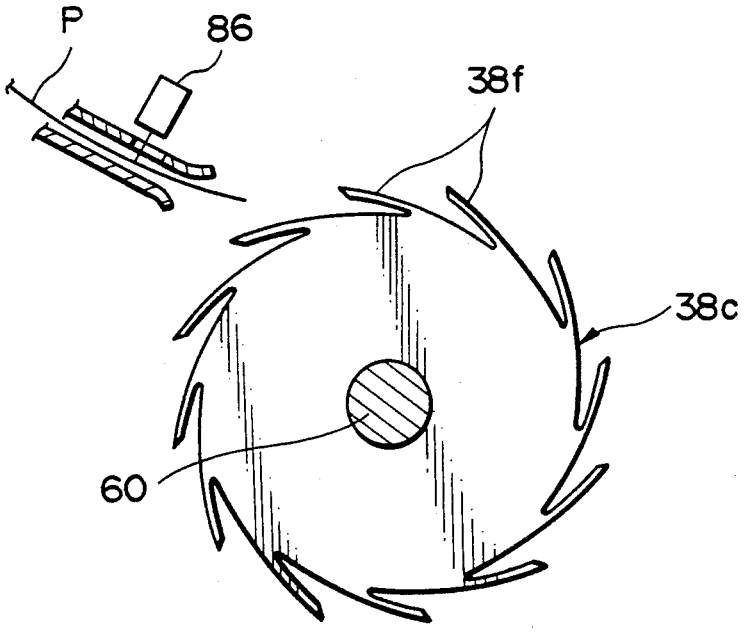

Further, as shown in FIG. 9, the reversing device 40 for turning over a paper sheet P may be implemented by a rotary pawl 38C provided on its outer periphery with a plurality of pawl members 38*f* which individually extend out in the tangential direction and are oriented in such a manner as to receive a paper sheet P each. This alternative arrangement allows an incoming paper sheet P to be surely received by the pawl members 38*f* even when it is fed askew.

Other advantages attainable with the above-described embodiment and modification are that they are operable even under a condition wherein paper sheets have to be fed at short intervals, that a stack of paper sheets is bodily shifted to a refeed position, and that a stack of paper sheets is aligned collectively.

It is to be noted that the drive wire 90 and motor 88 used to shift the paper stack on the intermediate tray 14 to the refeed position 27 may be replaced with any other suitable shifting means such as a belt.

Concerning the paper restraining device 58, a roller or a weight movable downward to press paper sheets may be substituted for the paper presser 56 and solenoid 56. The device 58 may even be of the kind pressing widthwise opposite edges of a paper sheet with respect to the paper transport direction.

With any of the embodiment and modification shown and described, it is possible to divide the intermediate tray 14 into two regions in the paper transport direction so that a stack of paper sheets may be refed in one of the regions adjacent to the pickup roller 28 while paper sheets are sequentially stacked in the other region adjacent to the stop 42. This is applicable only to a case wherein paper sheets whose size is one half of the maximum paper size usable with the copier 12 are used in the combination copy mode or in the two-sided copy mode, which causes a paper sheet to be circulated twice or more.

SECOND EMBODIMENT

A copier belonging to a family of image forming apparatuses to which a second embodiment of the present invention is applicable will be described first. The same or similar structural parts and elements as those of the first embodiment are designated by like reference numerals.

Figure 10:
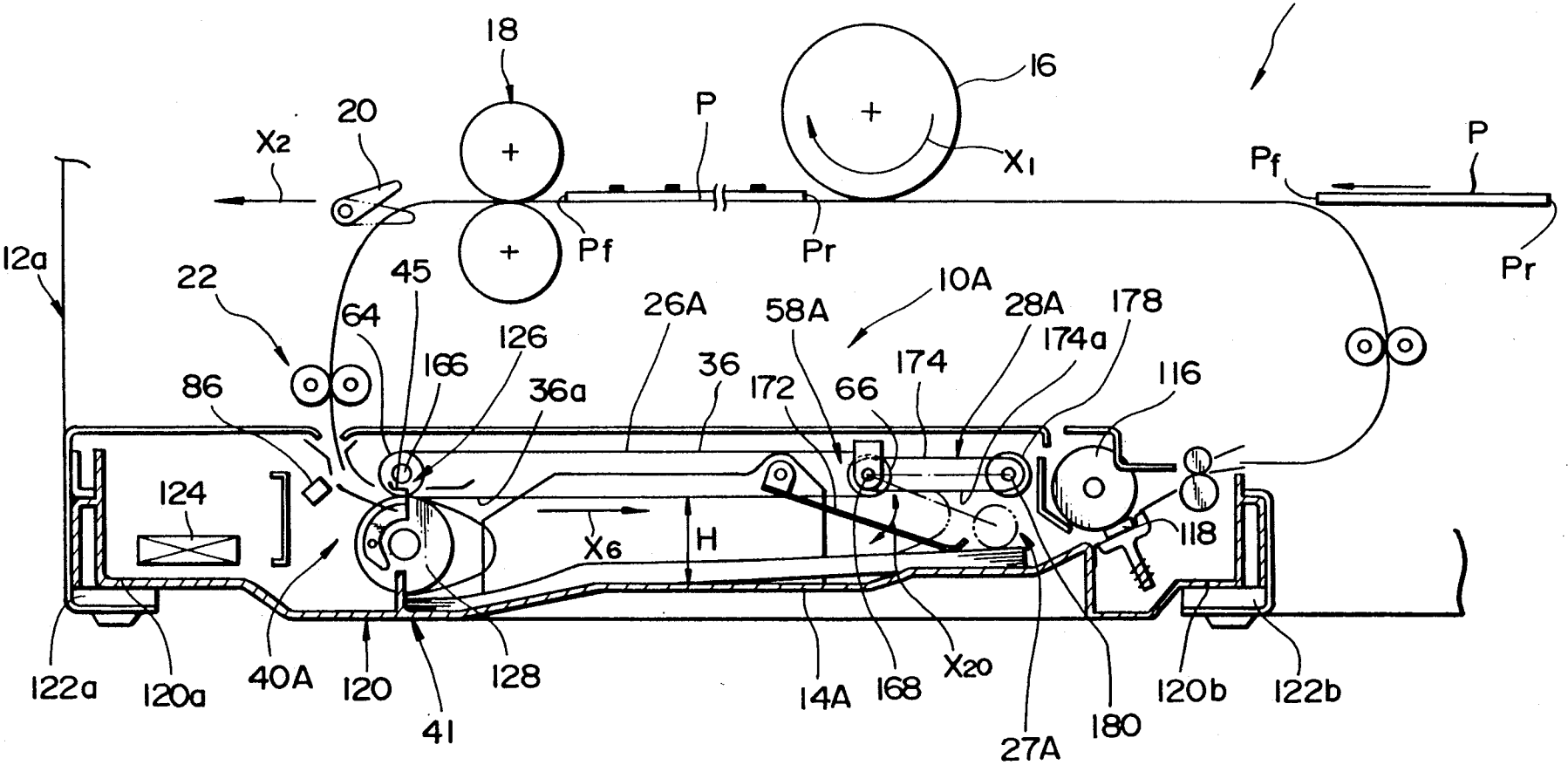
FIG. 10 is a fragmentary sectional side elevation of a copier to which a second embodiment of the present invention and its modification are applied.

Referring to FIG. 10 of the drawings, a copier 12A electrostatically forms a latent image on the photoconductive drum 16 and develops the latent image by a developing device (not shown). While the drum 16 is rotated as indicated by an arrow $X_1$ in the figure, the developed image is transferred from the drum 16 to a paper sheet P which is fed from a paper feeding device (not shown). The paper sheet P with the image is separated from the drum 16 and then transported to the fixing device 18 face up. In an ordinary copy mode as distinguished from the combination or the two-sided copy mode, the selector pawl 20 is switched over to a position indicated by a phantom line in the figure to allow the paper sheet P to be directly discharged in the direction $X_2$. In the combination or the two-sided copy mode, the selector pawl 20 is positioned as indicated by a solid line so that the paper sheet P carrying the image on one surface thereof is transported by the transport roller pair 22 and a stack control device 10A to be temporarily stacked on the intermediate tray 14. Subsequently, the paper sheet P is refed by a paper transport and refeed device 28A. A feed roller 116 and a friction pad 118 cooperate to separate the paper sheet P from the others while driving the paper sheet P toward the drum 16.

The control device 10A is constructed into a unit which is removable from the copier body **12*a* and is received in a casing 120. Specifically, the casing 120 has guide portions 120*a* and 120*b* at opposite sides thereof while the copier body 12*a* has support portions 122*a* and 122*b* at opposite sides thereof. When the casing 120 is pushed into the copier body 12*a* with the guide portions 120*a* and 120*b* engaging with the support portions 122*a* and 122*b*, respectively, a connector 124 mounted on the deepest portion of the casing 120 is brought into electrical connection with a connector which is provided on the copier body 12*a*. The control device 10A includes a reversing device 40A made up of a clamp mechanism 126 for clamping the leading edge Pf of an incoming paper sheet P and a rotary disk 128 rotatable to turn over the paper sheet P being clamped by the mechanism 126. A paper transport device 26A transports the trailing edge side of the paper sheet P toward an intermediate tray 14A. A sensor 86 is located downstream (at the left-hand side in FIG. 10) of the disk 128 with respect to the paper transport direction to sense the paper sheet P. A drive control device, which will be described, selectively rotates and stops the disk 128 for moving the clamp mechanism 126 between the paper receive position 45 and the paper hold position 41**.

The disk 128 is rotated upon the lapse of a predetermined period of time after the sensor 86 has sensed the leading edge of the paper sheet P, thereby shifting the clamp mechanism 126 from the paper receive position 45 to the paper hold position 41. After the trailing edge Pr of the paper sheet P has moved away from the paper receive position 45, the disk is rotated to return and stop the clamp mechanism 126 at the paper receive position 45. The sensor 86 may be implemented by a reflection type photosensor by way of example.

Figure 11:
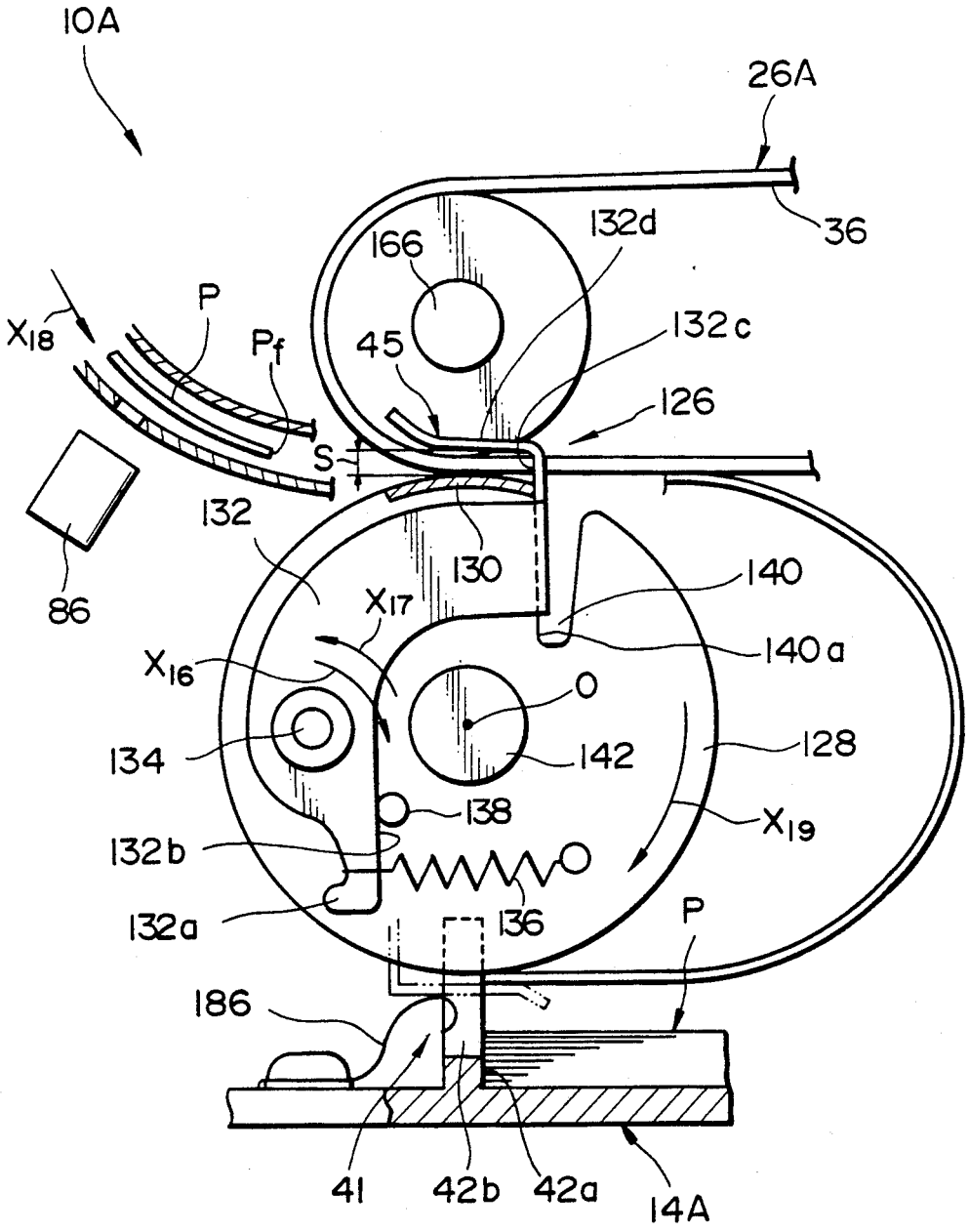
FIG. 11 is a partly sectional front view of an essential part of the second embodiment.

As shown in FIG. 11, the clamp mechanism 126 includes a clamp member 132 which is connected to the disk 128 by a pin 134 at an offset position relative to the center of rotation O of the disk 128 and in such a manner as to be selectively rotatable in a direction $X_{16}$ or a direction $X_{17}$. The clamp member 132 receives the leading edge Pf of the paper sheet P between itself and a friction sheet 130 which is fitted on a part of the circumferential edge of the disk 128 by adhesive, for example. A spring 136 is preloaded between one end **132*a* of the clamp member 132 and the disk 128 to constantly bias the clamp member 132 in the direction $X_{16}$. The movement of the clamp member 132 is limited when its side edge 132*b* abuts against a stop 138 which is provided on the disk 128. In this condition, the other end or contact surface 132*c* of the clamp member 132 is substantially coincident with an edge 140*a* of a notch 140 which is formed in the disk 128, a gap S being defined between a clamping portion 132*d* of the clamp member 132 and the friction sheet 130. In the paper receive position 45, the leading edge Pf of the paper sheet P coming in in a direction $X_{18}$ shown in FIG. 11 is received in the gap S. As soon as the leading edge Pf abuts against the abutting surface 132*c*, the clamping portion 132*d* is rotated in the direction $X_{17}$ toward the friction sheet 130 of the disk 128 to clamp the leading edge Pf. The friction sheet 130** may be implemented by a rubber sheet having a large coefficient of friction, for example.

Figure 12:
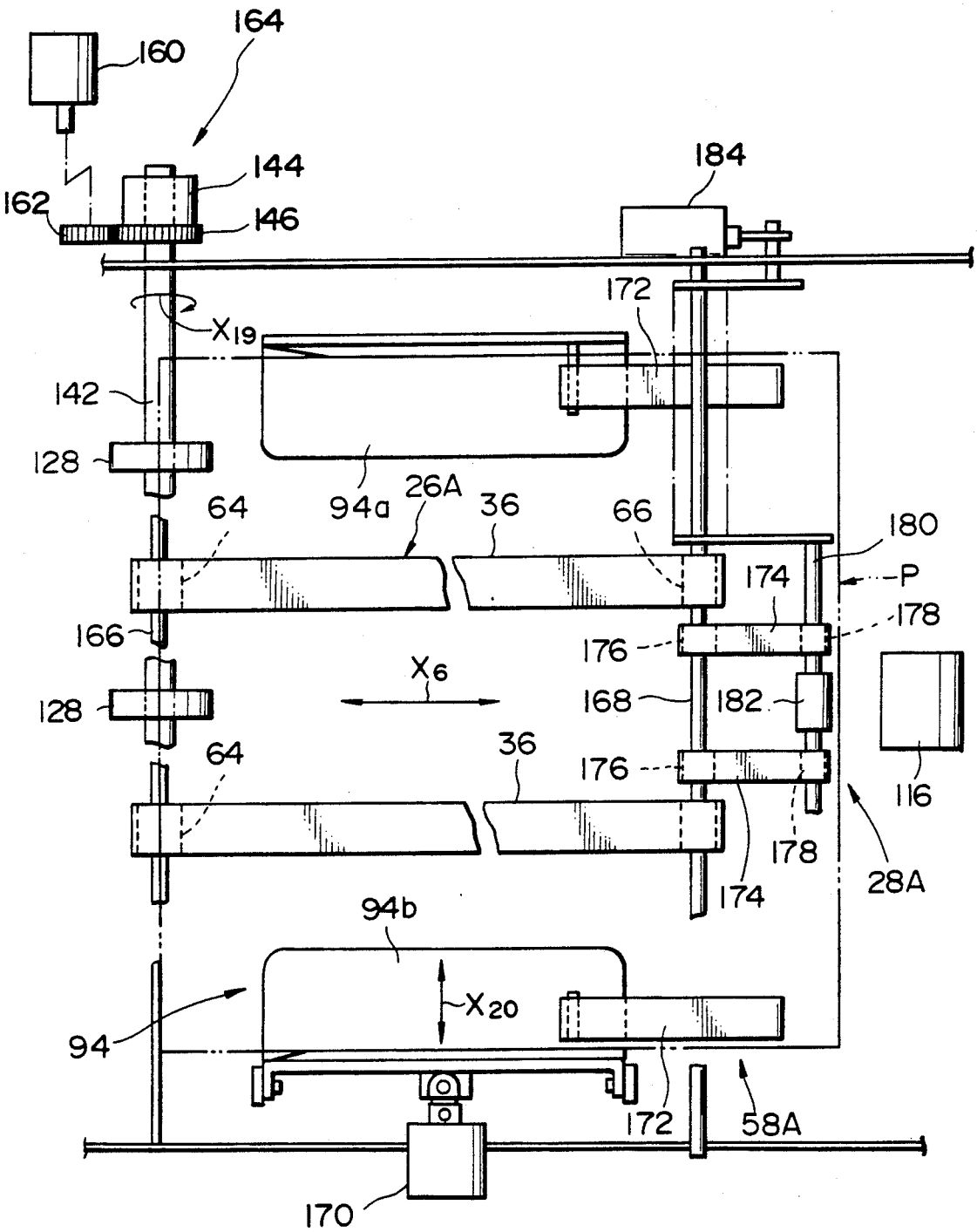
FIG. 12 is a front view of the arrangement shown in FIG. 11.
Figure 13:
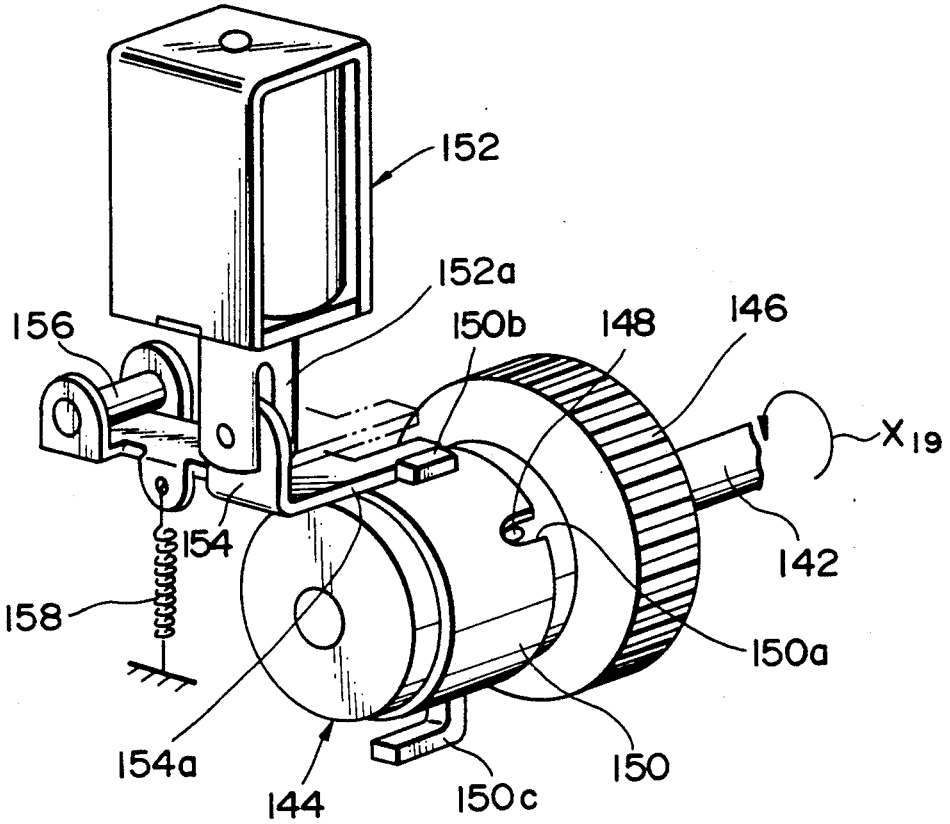
FIG. 13 is a perspective view showing a half-rotation clutch for stopping the rotation of a rotary disk included in the device of FIGS. 11 and 12 every time the disk completes a half rotation, and the neighborhood of the clutch.

The disk 128 has a substantially uniform radius as measured from the center O. As shown in FIG. 12, two such disks 128, for example, are provided at a predetermined distance from each other and securely mounted on a drive shaft 142 at their center. A half-rotation clutch 144 is implemented by a conventional spring clutch and mounted on one end of the drive shaft 142, so that the disk 128 may rotate by each half rotation and then stopped. Specifically, as shown in FIG. 13, a gear 146 is mounted on the drive shaft 142 through the clutch 144 while one of opposite clutch drums is fixed to the gear 146. The other clutch drum is fixed to the drive shaft 142 with a coil spring 148 being preloaded therebetween. A sleeve 150 is slidably coupled over the clutch drum, and a coil spring 148 is anchored at one end to a notch **150*a* which is formed in the sleeve 150**.

Figure 14:
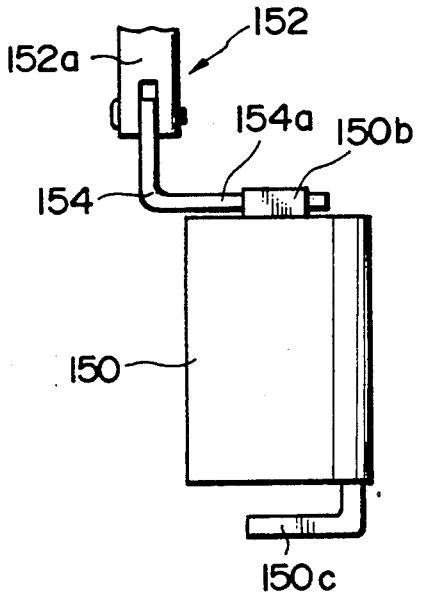
FIGS. 14 and 15 are front views each showing a different stop position for describing a mechanism which causes the half-rotation clutch of FIG. 13 to stop after each half rotation.
Figure 15:
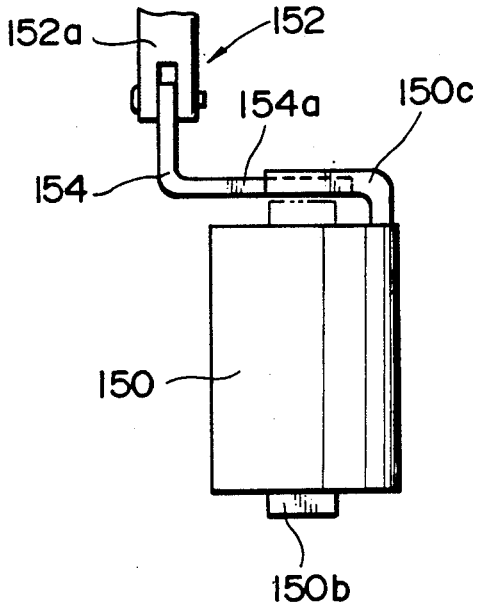

A lug **150*b* and a generally L-shaped lever 150*c* are provided on the outer periphery of the sleeve 150 at an angular distance of 180 degrees from each other. A solenoid 152 is located in the vicinity of the sleeve 150** while a stop 154 is rotatably connected to a plunger 152*a* of the solenoid 152. A return spring 158 is anchored to the stop 154 to constantly bias the latter downward. The stop 154 has a locking portion 154*a* which is so positioned as to be engageable with the lug 150*b* when the solenoid 162 is deenergized, as shown in FIG. 14, and engageable with the lever 150*c* when the solenoid 162 is energized, as shown in FIG. 15. The gear 146 is held in mesh with a drive gear 162 which is driven by a drive motor 160 shown in FIG. 12, whereby the gear 146 is rotatable in a direction indicated by an arrow $X_{19}$. In this particular embodiment, the drive motor 160, drive gear 162, gear 146, half-rotation clutch 144 and drive shaft 142 constitute a drive control device 164 which moves the disk 128 between the paper receive position 45 and the paper hold position 41.

As shown in FIG. 10, the paper transport device 26A is located to face the intermediate tray 14A and may be implemented by two parallel rubber belts 36 which extend in the direction $X_6$. The belts 36 are individually passed over the rollers 64 and 66 which are individually journalled to a stationary part of the copier 12A by roller shafts 166 and 168. The belts 36 are rotatable only in the direction $X_6$ of FIG. 10 as the roller shaft 166 is rotated. The lower surfaces, or paper transport surfaces, 36*a* of the belts 36 are positioned at substantially the same level as the upper end of the disk 128. The distance H between the paper transport surfaces 36*a* of the belts 36 and the intermediate tray 14A (which differs from one position to another because the surface of the tray 14A for loading paper sheets is not level) is an important consideration. Should the distance H is too small, the paper sheet P would be bent by a small radius of curvature during transport and therefor suffer from a curl during the two-sided copy mode operation. Should it be too large, a force necessary for the paper sheet P to be driven to the intermediate tray 14A would not be achievable. Preferably, therefore, the distance H should be 20 millimeters to 100 millimeters for ordinary paper sheets.

The surface of the belts 36 may be provided with undulation or a certain pattern to increase the paper transporting force, if desired. In the illustrative embodiment, the peripheral speed of the disks 128 is selected to be slightly lower than the peripheral speed of the transport roller pair 22 and that of the belts 36.

As shown in FIG. 12, the jogger 94 constituted by a pair of jogger fences 94*a* and 94*b* is disposed above the intermediate tray 14A for the purpose of aligning opposite side edges of incoming paper sheets P and preventing them from being refed askew. While one jogger fence 94*a* is fixed in place, the other jogger fence 94*b* is movable as indicated by an arrow $X_{20}$ in FIG. 12 driven by a solenoid 170. The paper receiving ends (left-hand side in FIG. 12) of the jogger fences 94*a* and 94*b* are each provided with a slant to increase the distance between the jogger fences 94*a* and 94*b*, so that they may receive the paper sheet P smoothly. Located downstream of the jogger fences 94*a* and 94*b* is a paper restraining device 58A for preventing the paper sheet P from being curled toward its face (so-called face curl). The paper restraining device 58A is constituted by paper pressers 172 which are rotatable in a direction indicated by an arrow $X_{20}$ in FIG. 10. The paper pressers 172 press the upper end of the paper stack from above by a force which is weak enough to insure the paper transport by the paper transporting device 26A and the paper refeed by the paper transport and refeed device 28A.

As shown in FIG. 10, the paper transport and refeed device 28A is situated downstream of the paper transport device 26A and implemented by two belts 174, for example. Each of the belts 174 has a paper transport surface 174*a* which is substantially coplanar with the paper transport surfaces 36*a* of the belts 36. The paper transport and refeed device 28A is movable between a position for transporting a trailing part of a paper sheet, as indicated by a solid line in FIG. 10, and a refeed position 27A for refeeding the stack of paper sheets P, as indicated by a phantom line (belts being not shown). As shown in FIG. 12, the belts 174 are parallel to each other and are individually passed over rollers 176 which are mounted on the shaft 168 and rollers 178 which are mounted on a shaft 180. A pickup roller 178 is mounted on the shaft 180 between the rollers 178. When a solenoid 184 fixed to a stationary part of the copier 12A is energized, the pickup roller 182 which is constantly rotated is lowered by a lever or the like onto the uppermost paper sheet P on the intermediate tray 14A so as to feed it to between the feed roller 116 and the friction pad 118.

Figure 16:
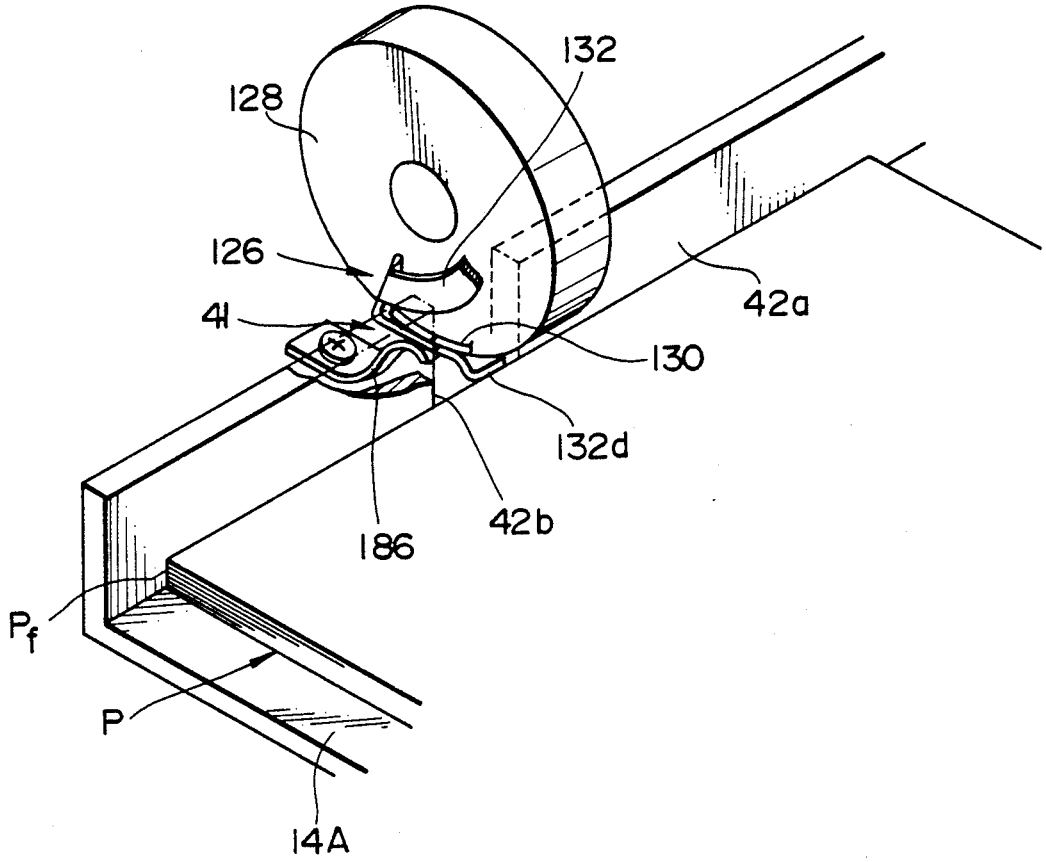
FIG. 16 is a perspective view showing a stack of paper sheets which are loaded on an intermediate tray with their leading edges alinged, and the neighborhood of a paper hold position.

FIG. 16 shows a stop surface 42*a* which is formed on the intermediate tray 14A for aligning the leading edges of the paper sheets P, together with its associated elements. The stop surface 42*a* extends perpendicularly to the surface of the tray 42 which is to be loaded with the paper sheets P. The wall of the tray 14A having the stop surface 42*a* is formed with a notch 42*a* at substantially the intermediate between opposite ends thereof. The disk 128 is received in the notch 42*a* in such a manner as not to interfere with the tray 14*a*. A leaf spring 186 is fastened to the intermediate tray 14A by a screw. When the clamp mechanism 126 of the disk 128 is shifted to the paper hold position 41 (as indicated by a phantom line in FIG. 11 also), the leaf spring 186 urges the lower surface of the clamping portion 132*d* of the clamp member 132 upward so that the friction sheet 130 of the disk 128 and the clamping portion 132*d* may continuously hold the leading edge Pf of the paper sheet P.

Figure 17:
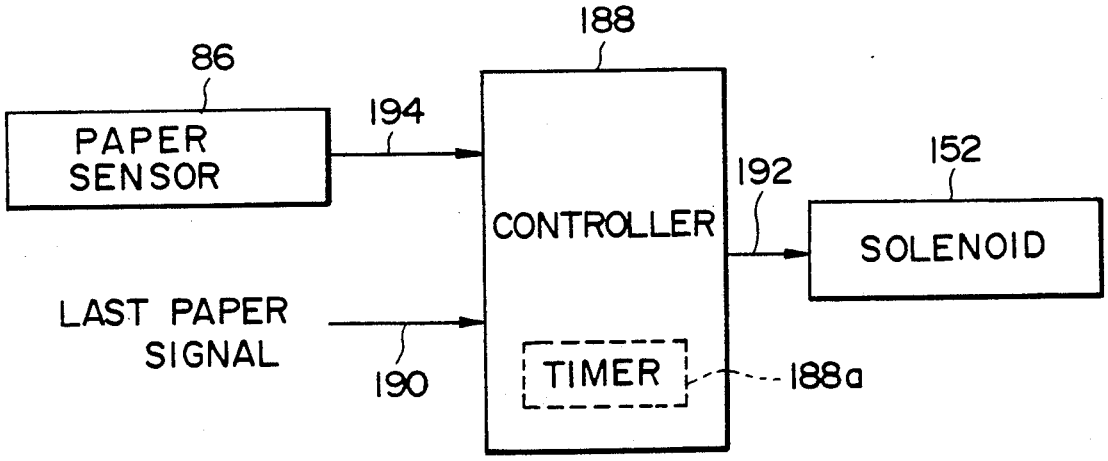
FIG. 17 is a block diagram schematically showing a controller for selectively moving a clamp mechanism to a paper receive position and the paper hold position by rotating the rotary disk, and elements associated therewith.

Referring to FIG. 17, a controller 188 for rotating the disk 128 to move the clamp mechanism 126 between the paper receive position 45 and the paper hold position 41 is shown together with its associated arrangements. Implemented as a microcomputer having various deciding and processing functions, the controller 188 receives a signal 194 from the paper sensor 86 and a signal 190 from a control section which is installed in the body 12*a* of the copier 12A for governing various image forming processes. The signal 194 continuously appears from the instant when the leading edge of a paper sheet arrives at the sensor 86 to the instant when the trailing edge of the same paper sheet moves away from the sensor 86. On the other hand, the signal 190 appears when the actual number of copies produced coincides with the set number of copies. In response to these signals, the controller 188 delivers a solenoid drive signal 192 to the solenoid 152 for turning it on and off selectively.

The operation of the second embodiment having the above construction will be described with reference also made to FIG. 18.

When it is desired to operate the copier 12A in the two-sided copy mode, this particular mode is selected on an operation board of the copier 12A, and then a copy start key on the operation board is pressed. A paper sheet P carrying an image on one surface thereof is fed from the fixing unit 18 toward the disk 128 by the transport roller pair 22, while the drive gear 162 is driven to rotate the gear 146 in the direction $X_{19}$. At this instant, since the lug 150*b* of the half-rotation clutch 144 of the disk 128 is locked by the locking portion 154*a* of the stop 154 as shown in FIG. 13, the driving force in the direction $X_{19}$ is not transmitted to the drive shaft 142 via the clutch 144 (i.e. the gear 146 idles) and, therefore, the disk 128 remains in a halt together with the drive shaft 142.

Figure 18:
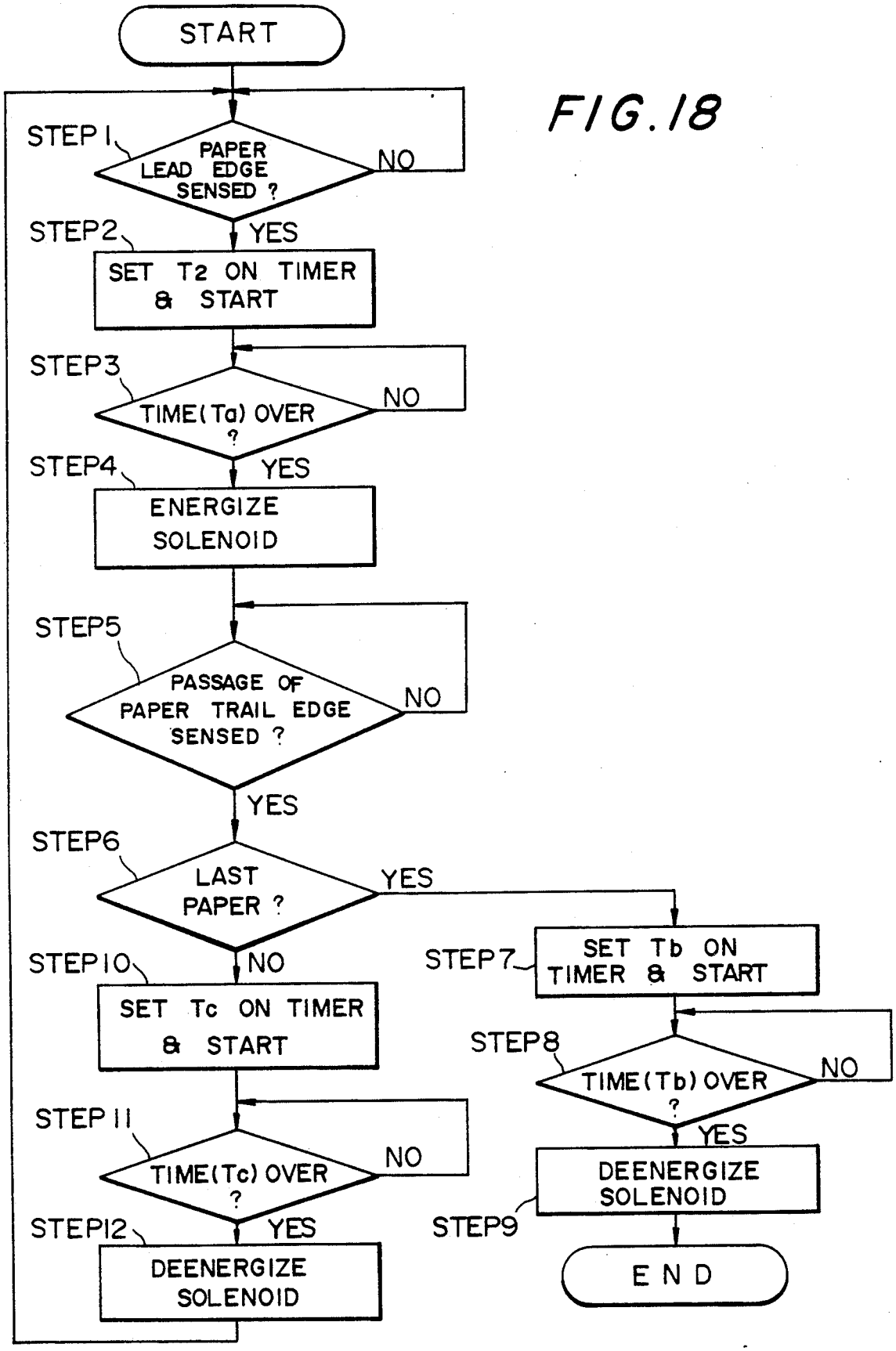
FIG. 18 is a flowchart representative of a routine which the controller of FIG. 17 executes for stopping the rotary disk after rotation.
Figure 19:
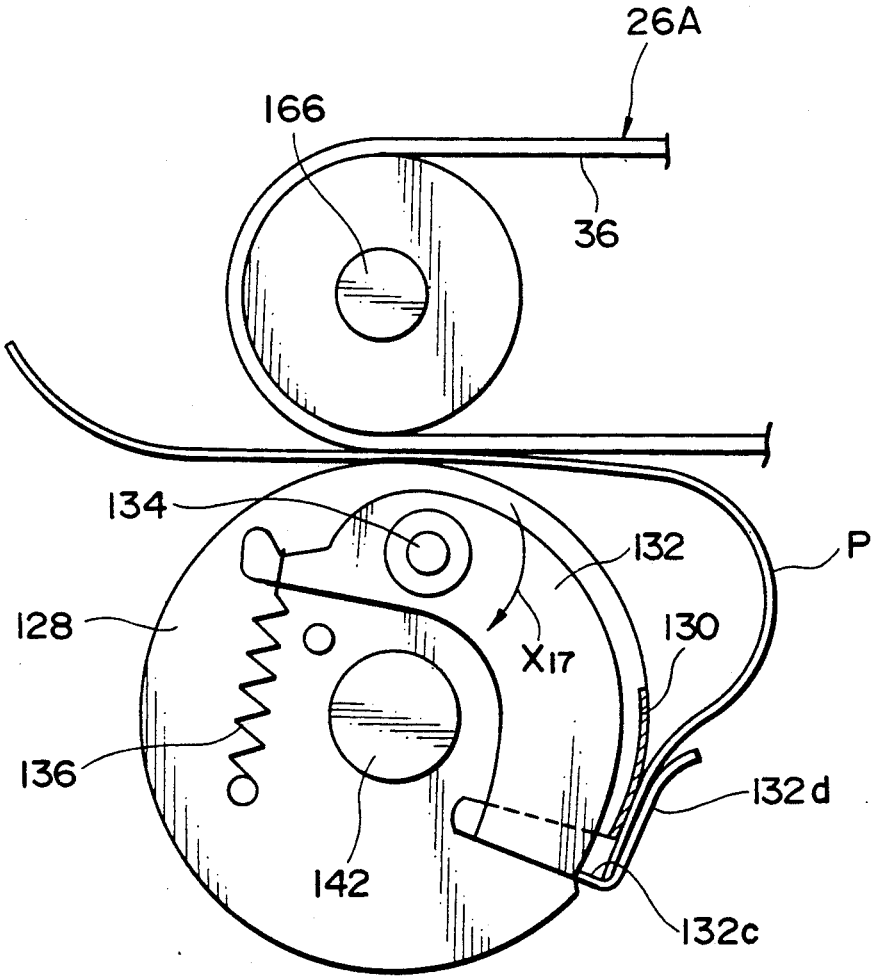
FIG. 19 is a front view schematically showing how the clamp mechanism is rotated while clamping the leading edge of a paper sheet.

Then, the controller 188 starts on the program shown in FIG. 18. The program begins with a STEP 1 for determining if the sensor 86 has sensed the leading edge of the paper sheet P. If the answer of the STEP 1 is NO, the program waits until the leading edge of the paper sheet P arrives at the sensor 86. As soon as the answer of the STEP 1 turns from NO to YES, a STEP 2 is executed to load a built-in timer 188*a* (FIG. 17) with a time Ta and start it. The timer 188*a* serves as a down-counter for down-counting clock pulses; the time Ta is representative of a count associated with a period of time necessary for the leading edge Pf of the paper sheet P to arrive at the clamping portion 132*d* of the clamp member 132. As the time Ta expires, the timer 188*a* ends the counting operation (i.e. the count becomes zero). Then, STEPS 3 and 4 are sequentially executed for delivering the solenoid drive signal 192 to the solenoid 152 (FIG. 13). This lifts the plunger 152*a* of the solenoid 152 to thereby shift the locking portion 154*a* of the stop 154 from the position of FIG. 14 to the position of FIG. 15. Consequently, the gear 146 and the drive gear 142 caused into operative connection to each other by the half-rotation clutch 144. Hence, the leading edge Pf of the paper sheet P is rotated together with the disk 128 in the direction $X_{19}$ while being received in the gap S shown in FIG. 11.

The peripheral speed of the disk 128 is lower than the peripheral speed of the transport roller pair 22 and that of the belts 36 of the paper transport device 26A, as stated earlier. Hence, while the disk 128 is rotated, the thrust of the advancing paper sheet P overcomes the returning force of the spring 136 to urge the contact surface 132*c* of the clamp member 132. Consequently, the clamp member 132 is rotated about the pin 134 in the direction $X_{17}$ relative to the disk 128, sequentially reducing the gap S. The disk 128, therefore, rotates with the leading edge Pf of the paper sheet P being retained in the gap S. As the disk 128 is rotated by 180 degrees to bring its clamp mechanism 126 to the paper hold position 41 as indicated by a phantom line in FIG. 11, the lever 150*c* of the half-rotation clutch 144 abuts against the locking portion 154*a* of the solenoid 152 which is in the lifted position (see FIG. 15). This prevents the disk 128 from being rotated any further. While the leading edge Pf of the paper sheet P is retained by the clamp member 132 and the friction sheet 130, a rear portion of the paper sheet P is driven by the transport roller pair 122 and paper transport device 26A. Consequently, the paper sheet P is transported as shown in FIG. 10 while being bent. Finally, the paper transport and refeed device 28A which is in the trailing edge transport position as indicated by a solid line drives the paper sheet P onto the intermediate tray 14A with its belts 174 while turning it over.

Since the paper sheet P is transported while being retained as stated above, it is free from incomplete stacking and, even if the paper sheet P is a relatively thick and rigid paper sheet, it is prevented from being released from the clamping mechanism 126. Even after the trailing edge of the paper sheet P has moved away from the transport roller pair 22, the paper sheet P bends and, due to its own elasticity, has its trailing edge held in contact with the paper transport surfaces 36*a* of the belts 36. This insures the transport until the paper sheet P has been fully turned over onto the intermediate tray 14A. Subsequently, the program executes a STEP 5 for determining whether or not the trailing edge of the paper sheet P has moved away from the sensor 86 by referencing the signal 194. If the answer of the STEP 5 is YES, a STEP 6 is executed.

In the STEP 6, whether or not the paper sheet P sensed by the STEP 1 is the last paper sheet is determined on the basis of the signal 190. If the paper sheet P moved away from the sensor 86 is the last paper sheet, the program advances to a STEP 7 for loading the timer 188*a* with a time Tb and starting it. The time Tb is longer than the previously mentioned time Ta and representative of a period of time necessary for the last paper sheet to be fully stacked on the intermediate tray 14A. Upon the lapse of the time Tb, the timer 188*a* ends the counting operation. Thereafter, STEPs 8 and 9 are executed to interrupt the solenoid drive signal 192, completing the program. If the paper sheet P is not the last paper sheet as decided in the STEP 6, a STEP 10 is executed to load the timer 188*a* with a time Tc and start it. The time Tc may be equal to the time Ta. As the time Tc expires, the timer 188*a* ends the counting operation. This is follows by STEPS 11 and 12 for interrupting the solenoid drive signal 192 to deenergize the solenoid 162. Then, the program returns to the STEP 1.

Therefore, as the time Tc expires (the trailing edge Pr of the paper sheet P moves away from the paper receive position 45) after the trailing edge Pr has moved away from the sensor 86, the disk 128 having its lever 150*c* locked by the locking portion 154*a* of the stop 154 as shown in FIG. 15 is allowed to resume the rotation. When the clamp mechanism 126 returns to the paper receive position 45 shown in FIG. 13, the stop 154 stops the lug 144*b* so that the rotation of the disk 128 is interrupted again.

As shown in FIG. 11, while the leading edge Pf of the paper sheet P is retained by the clamp member 132 and friction sheet 130, a leading end portion of the paper sheet abuts against the stop surface 42*a* of the intermediate tray 14A just before the leading edge Pf arrives at the paper hold position 41. Consequently, the leading edge Pf is temporarily retained while being slightly deviated from the contact surface 132*c* of the clamp member 132 (a clamping force acts between the clamping portion 132*d* and the friction sheet 130 which allows a paper sheet to be dislocated without damaging the leading edge Pf). After all of the set number of paper sheets P have been fully stacked on the intermediate tray 14A with the leading edges Pf thereof neatly aligned, the solenoid 184 is actuated to shift the paper transport and refeed device 28A from the trailing edge transport position to the refeed position. Then, the pickup roller 182 (FIG. 12) is lowered to sequentially refeed the stack of papers P, the uppermost paper sheet P being the first. The feed roller 116 and friction pad 118 cooperate to separate the paper sheet P being driven by the pickup roller 182 from the others, the separated paper sheet P being fed toward the drum 16.

Figure 20:
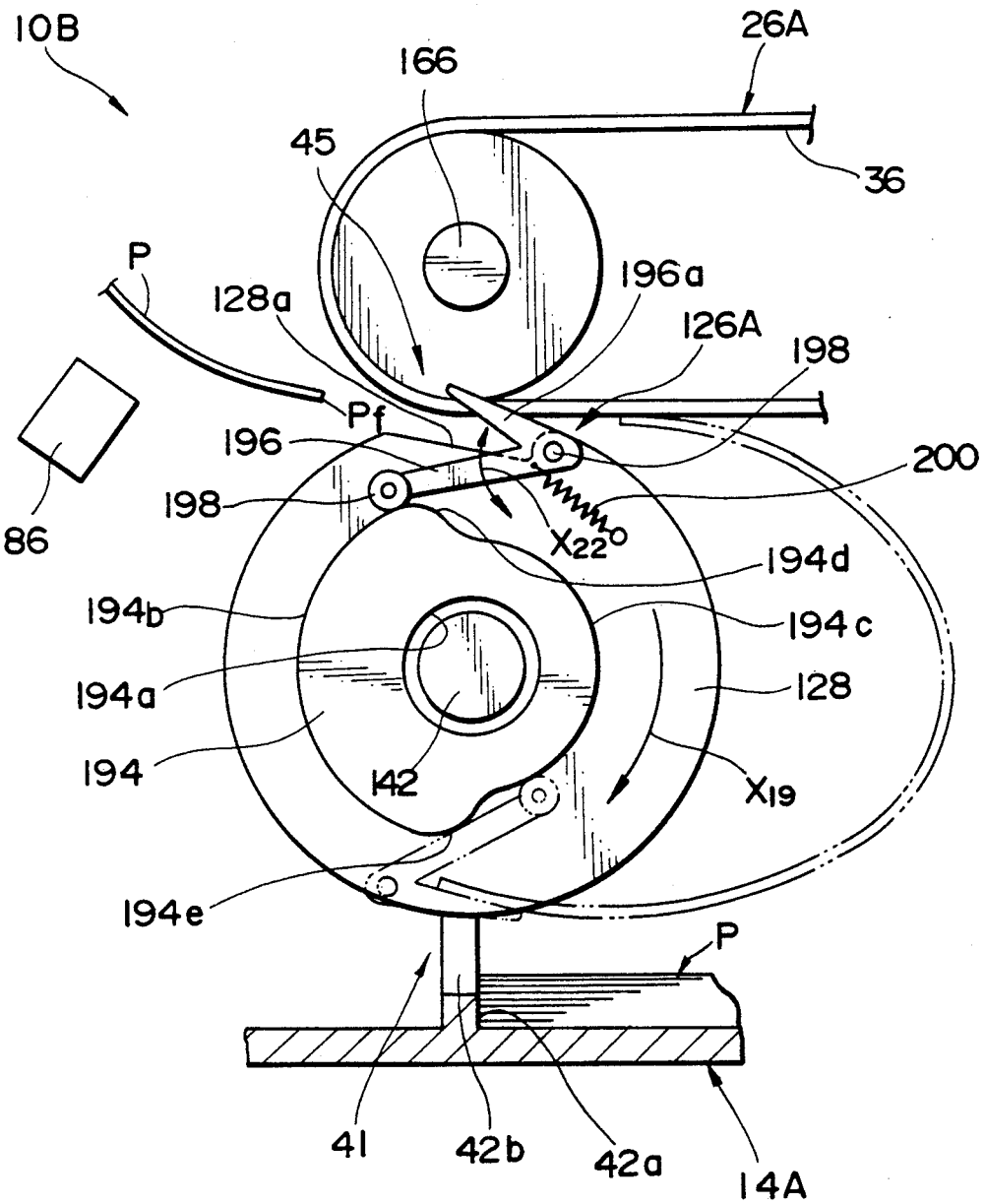
FIG. 20 is a partly sectional front view of a modification of the second embodiment.

FIG. 20 shows an alternative construction of the clamp mechanism 126. In the figure, similar components or structural elements are designated by the same reference numerals, and redundant operation will be omitted for simplicity. As shown, a control device 10B having a modified clamp mechanism 126A includes a stationary cam 194 which opens and closes a clamp lever 196 adapted to retain the leading edge Pf of the paper sheet P. The disk 128 rotates in the direction $X_{19}$ with the clamp mechanism 126A retaining the paper sheet P as stated above, thereby turning over the paper sheet P.

In detail, the clamp mechanism 126A includes a generally V-shaped clamp lever 196 having a clamping portion 196*a*, while the disk 128 is provided with a paper receiving portion 128*a* in a part of its peripheral portion. The clamping portion 196*a* and paper receiving portion 128*a* cooperate to retain the leading edge Pf of the paper sheet P. The clamp lever 196 is supported by a pin 198 to be rotatable as indicated by an arrow $X_{22}$ in FIG. 20. A roller 198 is journalled to an end of the clamp lever 196 remote from the clamping portion 196*a*. A spring 200 is anchored to the clamp lever 196 between the roller 198 and the pin 198, so that the roller 198 is constantly held in contact with the contour of the cam 194, the cam 194 is provided with an opening 194*a* at its center whose diameter is greater than the outside diameter of the drive shaft 142. The drive shaft 142 is received in the opening 194*a*, but it does not make contact with the cam 194. The cam 194 is securely connected to the intermediate tray 14A in the vicinity of the side end of the disk 128 by a support plate or similar member (not shown). The cam 194 includes a comparatively high cam surface 194*b* for opening the clamping portion 196*a* (i.e. rotating the clamp lever 196 clockwise), a comparatively low cam surface 194*c* for closing the clamping portion 196*a*, and an intermediate cam surface 196*d* interconnecting the two cam surfaces 194*b* and 194*c*. The intermediate cam surface 196*d* is so configured as to bring the clamping portion 196*a* substantially to the paper receive position 45. The cam 194 further includes a cam surface 194*e* on the opposite side to the cam surface 194*d*, so that the clamping portion 196*a* may be closed at the paper hold position 41.

In operation, when the sensor 86 senses the leading edge Pf of a paper sheet P, the disk 128 starts rotating in the direction $X_{19}$ upon the lapse of a predetermined period of time (necessary for the leading edge Pf of the paper sheet P to arrive at a position between the clamping portion 196*a* of the clamp lever 196 and the paper receiving portion 128*a* of the disk 128). Then, the roller or cam follower 198 of the clamp lever 196 is shifted from the high cam surface 194*b* to the low cam surface 194*c*. As a result, the clamp lever 196 is rotated counterclockwise to close the clamping portion 196*a* and, therefore, it is rotated with the clamping portion 196*a* clamping the leading edge Pf of the paper sheet P. The disk 128 is brought to a stop after being rotated by substantially 180 degrees (by the operation of the half-rotation clutch 144 as in the second embodiment). Since the cam follower 198 is stopped on the low cam surface 194*c* which immediately precedes the intermediate cam surface 194*e*, the clamping portion 196*a* reaching the paper hold position 41 is held in the closed position, as indicated by a phantom line in FIG. 20. Then, as in the second embodiment, the disk 128 is rotated again after the trailing edge Pr of the paper sheet P has moved away from the paper receive position 45, so that the clamp mechanism 126A is returned to the paper receive position 45 and stopped there.

In this modification, as in the second embodiment, the force exerted by the clamp mechanism 126A at the paper hold position 41 is weak enough to allow the paper sheet P to be readily released from the clamping portion 196*a* when pulled out. Since the clamp mechanism 126A is closed by the cam 194 with no regard to the thrust of the paper sheet P, even a thinner and less rigid paper than in the second embodiment can be surely turned over and stacked on the intermediate tray 14A and, yet, the leading edge Pf of the paper sheet P is prevented from being damaged or from jamming the transport path.

While the second embodiment and its modification have been shown and described in relation to the two-sided copy mode, they are readily operable even in the combination copy mode in which a paper sheet P should be stacked on the intermediate tray 14A without being turned over. Specifically, the combination copy mode can be implemented by, for example, providing a lug, solenoid and stop corresponding respectively to the lug 150*b*, solenoid 152 and stop 154 shown in FIG. 13 for stopping the clamp mechanism 126 or 126A at the paper hold position 41 and paper receive position 45 of FIG. 11, such that the clamp mechanism 126 or 126A is temporarily retracted from the paper transport path when the solenoid is energized. It is necessary, however, that the exclusive lug, solenoid and stop for the combination copy mode be so located as not to effect the two-sided copy mode.

The paper transport device 26A for driving the trailing portion of a paper sheet into the intermediate tray 14A is not limited to the belts shown and described and may alternatively be implemented by a plurality of groups of rollers (see FIG. 8) which are arranged in the paper transport direction.

In FIG. 10, the trailing portion of a paper sheet P is transported by the paper transport device 26A and paper transport and refeed device 28A in order to reduce the length of the device 26A in the paper transport direction and thereby the overall dimensions of the copier. However, the transport and refeed device 28A is omissible if an arrangement is made such that a paper sheet P is transported only by the paper transport device 26A until the paper trailing portion has been fully turned over. In such a case, the paper transport and refeed device 28A is replaced with an exclusive pickup roller for refeed. This exclusive pickup roller may be located downstream of and somewhat remote from the paper transport device 26A, and an extra device may be provided for moving a stack of paper sheets on the intermediate tray 14A in the paper transport direction (to the right in FIG. 10) to a position where the pickup roller is engageable with the right end of the stack. Such an arrangement will allow paper sheets of larger sizes to be surely stacked on the intermediate tray 14A.

In any of the embodiment and its modification described above, when the paper sheet to be stacked on the intermediate tray 14A is the last paper sheet, the period of time during which the clamp mechanism 126 or 126A retains the leading edge Pf of the paper sheet at the paper hold position (corresponding to the time Tb in the STEP 9 of FIG. 18) is selected to be equal to a period of time necessary for the last paper sheet to be fully stacked on the tray 14A, and is longer than the period of time associated with the other paper sheets. This is because paper sheets except for the last sheet have their leading edges pressed by the successive sheets which are sequentially fed into the tray 14A while being bent, i.e., the clamp mechanism 126 or 126A serves to forcibly retain the last sheet until the latter has been fully stacked on the tray 14A. The time Tb may be varied in matching relation to the dimension of a paper sheet as measured in the paper transport direction.

In summary, the present invention achieves various unprecedented advantages as enumerated below:

(1) An operation mode in which a paper sheet has to be turned over can be implemented by a considerably short paper transport path;

(2) A paper transport path defined in an image forming apparatus is simplified to reduce the overall dimensions of the apparatus;

(3) A paper sheet can be stacked on an intermediate tray while being located in a predetermined position on the tray, i.e., efficient and reliable stacking is enhanced;

(4) A paper sheet temporarily stacked on the intermediate tray is prevented from being displaced; and (5) Even if a paper sheet stacked on the intermediate tray has a curl, a paper sheet transported next can be stacked smoothly because the curled sheet is pressed from above.

Various modifications will become possible for those skilled in the art after receiving the teachings of the present disclosure without departing from the scope thereof.

What is claimed is:

1. In an image forming apparatus in which a paper sheet carrying an image on one surface thereof is temporarily stacked on an intermediate tray which is disposed on a paper transport path, a device for controlling stacking of said paper sheet on said intermediate tray, comprising:

transport means having a portion thereof juxtaposed to said intermediate tray for transporting the paper sheet to said intermediate tray;

rotatable reversing means, attached to a drive shaft by a slip clutch, for stacking the paper sheet on said intermediate tray while turning over the paper sheet, said rotatable reversing means having a retaining portion for receiving and retaining a leading edge of the paper sheet to be turned over when said rotatable reversing means is rotated to a paper receive position and a contact surface for contacting an adjacent surface to thereby exert a load on said rotatable reversing means greater that a predetermined load so that the slip clutch idles to temporarily stop rotation of said rotatable reversing means prior to the paper receive position when the paper sheet has a size greater than a predetermined size;

positioning means for positioning said leading edge of the paper sheet stacked on said intermediate tray by said reversing means at a paper hold position which is defined at said intermediate tray; and restraining means for restraining the paper sheet positioned on said intermediate tray by said positioning means at said paper hold position.

2. A device as claimed in claim 1, further comprising drive control means for controllably driving said rotatable reversing means such that the paper sheet is shifted from said paper receive position to said paper hold position on said intermediate tray while being turned over by said reversing means.

3. A device as claimed in claim 2, wherein said drive control means controls said rotatable reversing means such that, when the paper sheet being fed into said intermediate tray by said transporting means and said reversing means has a size greater than the predetermined size, said paper sheet is continuously transported by said portion of said transporting means juxtaposed to said intermediate tray even after said paper sheet has been turned over by said reversing means.

4. A device as claimed in claim 2, wherein said drive control means controls said rotatable reversing means to rotate to a position such that a function of said reversing means is invalidated.

5. A device as claimed in claim 1, wherein said restraining means restrains a portion of the paper sheet stacked on said intermediate tray which is close to the leading edge of said paper sheet.

6. A device as claimed in claim 1 wherein said restraining means restrains a portion of the paper sheet stacked on said intermediate tray which is close to a trailing edge of said paper sheet.

7. In an image forming apparatus in which a paper sheet carrying an image on one surface thereof is temporarily stacked on an intermediate tray which is disposed on a paper transport path, a device for controlling stacking of said paper sheet on said intermediate tray, comprising:

transporting means having a portion thereof juxtaposed to said intermediated tray for transporting the paper sheet to said intermediate tray;

rotatable reversing means for stacking the paper sheet on said intermediate tray while turning over the paper sheet;

positioning means for positioning a leading edge of the paper sheet stacked on said intermediate tray by said reversing means at a paper hold position which is defined at said intermediate tray;

drive control means for controllably driving said rotatable reversing means such that the paper sheet is shifted from a paper receive position to said paper hold position on said intermediate tray while being turned over by said reversing means;

invalidating means for invalidating a function of said reversing means; and restraining means for restraining the paper sheet positioned on said intermediate tray by said positioning means at said paper hold position.

8. A device as claimed in claim 7, wherein said rotatable reversing means comprises clamping means for clamping the leading edge of the paper sheet entering said paper receive position, and rotary means rotatable integrally with said clamping means.

9. A device as claimed in claim 8, wherein said rotary means comprises a rotatable disk on a circumferential edge of which is provided said clamping means in the form of a retaining portion.

10. A device as claimed in claim 8, wherein said clamping means comprises a clamp member rotatably mounted on said rotary means in an eccentric position relative to a center of rotation of said rotary means for receiving the leading edge of the paper sheet between said clamp member and a part of a circumferential edge of said rotary means at said paper receive position, said clamp member clamping the leading edge of said paper sheet by contacting at said paper receive position with said paper sheet advancing to between said clamp member and said part of the circumferential edge of said rotary means and by rotating toward said part of the outer periphery of said rotary means.

11. A device as claimed in claim 8, further comprising sensor means located on said paper transport path upstream of said reversing means for sensing arrival of the paper sheet at said paper receive position.

12. A device as claimed in claim 11, said drive control means controls said rotatable reversing means such that, upon lapse of a predetermined period of time after said sensor means has sensed the leading edge of the paper sheet, said rotary means of said rotatable reversing means is rotated to shift said clamp means from said paper receive position to said paper hold position and, upon lapse of a predetermined period of time after said sensor means has sensed the trailing edge of said paper sheet, said rotary means is rotated to shift said clamp means to said paper receive position.

13. A device as claimed in claim 7, further comprising transporting and refeeding means located on said paper transport path downstream of said transporting means and selectively movable to a trailing edge transport position where a paper transport surface of said transporting and refeeding means becomes substantially coplanar with a paper transport surface of said transporting means, and a refeed position for refeeding the paper sheet stacked on said intermediate tray.

* * * * *